US009877599B2

(12) United States Patent
Turner et al.

(10) Patent No.: US 9,877,599 B2
(45) Date of Patent: Jan. 30, 2018

(54) BASKET PRODUCT DISPLAY AND RELATED METHODS

(71) Applicant: DCI Marketing, Inc., Milwaukee, WI (US)

(72) Inventors: Christopher J. Turner, Pewaukee, WI (US); Christopher J. Terpstra, Hartford, WI (US)

(73) Assignee: Retail Space Solutions LLC, Milwaukee, WI (US)

( * ) Notice: Subject to any disclaimer, the term of this patent is extended or adjusted under 35 U.S.C. 154(b) by 0 days.

(21) Appl. No.: 15/048,050

(22) Filed: Feb. 19, 2016

(65) Prior Publication Data

US 2016/0166084 A1 Jun. 16, 2016

Related U.S. Application Data

(63) Continuation of application No. 14/276,840, filed on May 13, 2014, now abandoned.
(Continued)

(51) Int. Cl.
*A47F 1/12* (2006.01)
*A47F 5/00* (2006.01)
*A47F 3/04* (2006.01)

(52) U.S. Cl.
CPC ..... *A47F 1/12* (2013.01); *A47F 1/121* (2013.01); *A47F 3/0443* (2013.01);
(Continued)

(58) Field of Classification Search
CPC .... A47F 1/04; A47F 1/12; A47F 1/121; A47F 1/128; A47F 3/02; A47F 3/0486;
(Continued)

(56) References Cited

U.S. PATENT DOCUMENTS 1,524,748 A * 2/1925 O'Connor ..... A47F 1/08 211/59.2
1,758,098 A * 5/1930 Williams ..... A47F 5/005 211/59.2
(Continued)

FOREIGN PATENT DOCUMENTS

DE 8717386 3/1988
EP 0035342 A2 * 9/1981 ..... A47F 5/106
(Continued)

OTHER PUBLICATIONS

Patent Cooperation Treaty, International Searching Authority, Notification of Transmittal of the International Search Report and the Written Opinion of the International Searching Authority, or the Declaration, dated Apr. 2, 2015, 8 pp.
(Continued)

*Primary Examiner* — Stanton L Krycinski
(74) *Attorney, Agent, or Firm* — Fitch, Even, Tabin & Flannery LLP

(57) ABSTRACT

A product display is providing having a vertical support and a product basket configured to mount to the vertical support and display product in a front-facing manner in which product from a rear of the product basket is automatically biased toward a front of the product basket, wherein at least one of the vertical support and the product basket are configured to display a particular product in order to improve product pack out in at least one of a vertical and a horizontal direction within the product display. In one form, both the basket and vertical support are dimensioned or sized based on the specific product being displayed so that product pack out is improved, if not maximized, in both the vertical and horizontal direction.

8 Claims, 26 Drawing Sheets

Related U.S. Application Data

(60) Provisional application No. 61/910,888, filed on Dec. 2, 2013, provisional application No. 61/943,118, filed on Feb. 21, 2014.

(52) U.S. Cl.
CPC ..... *A47F 5/0018* (2013.01); *A47F 5/0025* (2013.01); *A47F 5/0031* (2013.01)

(58) Field of Classification Search
CPC ..... A47F 3/06; A47F 5/0025; A47F 5/0031; A47F 5/0081; A47F 5/0093; A47F 5/01; A47F 5/0807; A47F 5/083; A47F 5/0838; A47F 5/0853; A47F 5/10; A47F 5/13; A47B 47/022
See application file for complete search history.

(56) References Cited

U.S. PATENT DOCUMENTS 2,443,871 A * 6/1948 Shield ..... A47F 7/285 126/39 B
2,649,207 A * 8/1953 Shield ..... A47F 1/12 211/59.2
2,954,129 A * 9/1960 Gordon ..... A47F 1/126 211/59.3
3,007,580 A * 11/1961 Dickson, Jr. ..... A47F 1/121 211/59.3
3,110,402 A * 11/1963 Mogulescu ..... A47F 1/126 211/59.3
3,528,558 A * 9/1970 Williams ..... A47F 5/0025 211/126.1
3,545,624 A * 12/1970 Krikorian ..... A47F 5/01 211/126.15
4,314,648 A * 2/1982 Spamer ..... A47F 1/12 193/2 R
4,331,243 A * 5/1982 Doll ..... A47F 1/121 211/181.1
4,348,965 A * 9/1982 Swanson ..... A47F 5/13 108/106
4,416,380 A * 11/1983 Flum ..... A47F 1/121 211/181.1
4,565,725 A * 1/1986 Spamer ..... A47F 1/12 156/244.25
4,702,380 A * 10/1987 Herman ..... A47F 5/083 211/181.1
4,732,282 A * 3/1988 Lockwood ..... A47F 7/28 211/59.2
4,785,945 A * 11/1988 Rowse ..... A47F 5/005 108/64
4,809,855 A 3/1989 Bustos
4,890,746 A * 1/1990 Trulaske, Sr. ..... A47F 1/12 211/153
4,901,869 A * 2/1990 Hawkinson ..... A47F 1/126 211/184
4,955,486 A * 9/1990 Trulaske, Sr. ..... A47F 1/12 211/153
5,022,535 A * 6/1991 Spamer ..... A47F 5/103 211/187
5,076,443 A * 12/1991 Trulaske, Sr. ..... A47F 1/12 211/153
5,197,610 A * 3/1993 Bustos ..... A47F 5/0093 211/150
5,203,255 A * 4/1993 Wells ..... A47F 3/001 126/21 A
5,253,770 A * 10/1993 Rosenthal ..... A47F 5/0025 211/106
5,255,803 A * 10/1993 Pavone ..... A47F 5/00 211/189
5,614,288 A * 3/1997 Bustos ..... A47F 1/12 211/59.2
5,687,854 A * 11/1997 Anderson ..... A47K 10/22 211/59.2
5,702,008 A 12/1997 Thalenfeld
5,769,248 A * 6/1998 Johnson ..... A47F 5/0807 211/103
5,815,970 A 10/1998 Thalenfeld
5,826,359 A 10/1998 Thalenfeld
5,855,283 A * 1/1999 Johnson ..... A47F 1/126 211/103
5,860,239 A 1/1999 Thalenfeld
5,862,923 A * 1/1999 Nordquist ..... A47F 5/0043 211/59.2
5,865,323 A * 2/1999 Lecroy ..... A47F 7/28 211/183
5,887,731 A 3/1999 Thalenfeld
5,901,487 A 5/1999 Thalenfeld
5,904,256 A * 5/1999 Jay ..... A47F 5/0025 211/175
5,921,412 A * 7/1999 Merl ..... A47B 96/028 211/181.1
5,941,003 A 8/1999 Thalenfeld
5,979,674 A 11/1999 Thalenfeld
6,050,428 A * 4/2000 Hollander ..... B65G 1/02 211/135
6,141,894 A 11/2000 Thalenfeld
6,196,401 B1 * 3/2001 Brady ..... A47F 1/121 211/186
6,299,001 B1 * 10/2001 Frolov ..... A47F 5/01 211/106
6,328,170 B1 * 12/2001 Lee ..... A47F 1/121 211/153
6,604,310 B1 8/2003 Lindstrom
6,651,828 B2 * 11/2003 Dimattio ..... A47F 5/005 108/60
6,672,464 B2 * 1/2004 Robertson ..... A47F 7/28 211/153
6,715,621 B2 * 4/2004 Boron ..... A47F 1/12 211/175
6,719,152 B1 4/2004 Nagel
6,745,906 B1 6/2004 Nagel
6,866,155 B2 3/2005 Nagel
6,866,156 B2 3/2005 Nagel
6,886,699 B2 * 5/2005 Johnson ..... A47F 1/126 108/61
6,886,700 B2 5/2005 Nagel
6,889,855 B2 5/2005 Nagel
7,028,852 B2 * 4/2006 Johnson ..... A47F 1/126 108/60
7,118,001 B2 * 10/2006 Klein ..... A47B 96/16 211/119.004
7,124,898 B2 * 10/2006 Richter ..... A47F 1/126 211/184
7,665,618 B2 * 2/2010 Jay ..... A47F 1/12 211/59.2
7,854,333 B2 * 12/2010 Kottke ..... A47F 1/12 211/59.2
8,540,088 B2 * 9/2013 Brasher ..... A47F 5/083 211/106
8,919,583 B2 * 12/2014 Brasher ..... A47F 5/083 211/106
2002/0027115 A1 * 3/2002 Gay ..... A47B 57/045 211/187
2004/0060884 A1 * 4/2004 Nook ..... A47F 5/0807 211/189
2004/0084392 A1 * 5/2004 Richter ..... A47F 5/0838 211/59.3
2004/0256341 A1 * 12/2004 Donnell ..... A47F 1/12 211/187
2005/0189310 A1 * 9/2005 Richter ..... A47F 1/126 211/59.3
2005/0230338 A1 * 10/2005 Farinola ..... A47F 5/0838 211/186
2005/0279041 A1 * 12/2005 Staples ..... A47B 55/02 52/506.06
2006/0091092 A1 * 5/2006 Vosbikian ..... A47F 5/083 211/87.01
2006/0180557 A1 * 8/2006 Weinstein ..... A47B 55/02 211/40

(56) References Cited

U.S. PATENT DOCUMENTS

| | | | | |
|---|---|---|---|---|
| 2006/0186064 | A1 | 8/2006 | Merit | |
| 2006/0260518 | A1 | 11/2006 | Josefsson | |
| 2006/0273056 | A1* | 12/2006 | Smits | A47F 5/01 211/189 |
| 2008/0011696 | A1* | 1/2008 | Richter | A47F 1/126 211/59.2 |
| 2008/0129161 | A1* | 6/2008 | Menz | A47F 1/12 312/120 |
| 2008/0156751 | A1* | 7/2008 | Richter | A47F 1/126 211/59.2 |
| 2008/0164229 | A1* | 7/2008 | Richter | A47F 1/126 211/59.2 |
| 2008/0296241 | A1 | 12/2008 | Alves | |
| 2008/0314852 | A1* | 12/2008 | Richter | A47F 1/12 211/184 |
| 2009/0039040 | A1* | 2/2009 | Johnson | A47F 5/0025 211/120 |
| 2009/0079304 | A1* | 3/2009 | Price | A47F 5/00 312/138.1 |
| 2009/0194492 | A1* | 8/2009 | Brasher | A47F 5/083 211/49.1 |
| 2010/0176075 | A1 | 7/2010 | Nagel | |
| 2011/0226775 | A1* | 9/2011 | Shea | A47F 5/0031 220/476 |
| 2011/0278246 | A1* | 11/2011 | Daily | A47F 5/0018 211/59.2 |
| 2013/0193095 | A1* | 8/2013 | Nagel | A47F 1/04 211/59.3 |

FOREIGN PATENT DOCUMENTS

| | | | | |
|---|---|---|---|---|
| EP | 0071532 | A2 * | 2/1983 | A47F 5/13 |
| FR | 2529451 | A1 * | 1/1984 | A47F 1/121 |
| FR | 2702352 | A1 * | 9/1994 | A47B 91/00 |
| FR | 2724098 | | 3/1996 | |
| FR | 2767461 | A1 * | 2/1999 | A47F 5/101 |
| FR | 2791539 | | 10/2000 | |
| FR | 2791539 | A1 * | 10/2000 | A47F 1/121 |
| GB | 2386116 | | 9/2003 | |
| JP | H0369459 | U | 7/1991 | |
| JP | H07241227 | | 9/1995 | |
| NL | 1000819 | C2 * | 9/1996 | A47F 1/121 |
| NL | 9500143 | A * | 9/1996 | A47F 1/04 |
| WO | 9951123 | | 10/1999 | |
| WO | 2002091885 | | 11/2001 | |

OTHER PUBLICATIONS

Patent Cooperation Treaty, International Searching Authority, Notification of Transmittal of the International Search Report and the Written Opinion of the International Searching Authority, or the Declaration, dated Apr. 29, 2015, 12 pp.

United States Patent and Trademark Office, Non-final Office Action issued in U.S. Appl. No. 14/276,840, dated Jan. 14, 2015, 20 pp.

* cited by examiner

BASKET PRODUCT DISPLAY AND RELATED METHODS

CROSS REFERENCE TO RELATED APPLICATIONS

This application is a continuation of prior application Ser. No. 14/276,840, filed May 13, 2014 (File No. 20257-132664), which claims the benefit of U.S. Provisional Application No. 61/910,888, filed Dec. 2, 2013 (File No. 20091-131973), and U.S. Provisional Application No. 61/943,118, filed Feb. 21, 2014 (File No. 20091-132450) all of which are incorporated herein by reference in their entirety.

TECHNICAL FIELD

This invention relates generally to a retail product display, and more specifically a basket type display for packaged goods such as yogurt containers and the like, and related methods.

BACKGROUND

Product displays for use in retail environments are generally designed to display products in a manner such that they are easily accessible by a consumer. Conventional product displays must take advantage of as much horizontal and vertical space available so as to maximize the amount of product displayed. For example, retail displays for yogurt products must accommodate packages of varying dimensions while still maximizing available space.

Generally speaking, particular yogurt manufacturers or brands use uniform product sizing across their product lines, but packaging size and shape differs from one manufacturer to another. It is common for retailers to vertically stack a particular brands' product so that various flavors of a particular brand may be located near one another for the consumer's convenience. Unfortunately, due to the differences in packaging size and shape between the various manufacturers or brands, this often means that unnecessary gaps exist between some product and existing store shelving because the shelving units have to be spaced to accommodate more than one brand of product. These gaps occur vertically due to the various heights of the different brands of product and horizontally due to the various widths of the different brands of product. Although yogurt has been used as an example of where such problems occur, it should be understood that the same is true for many different product displays.

Existing configurations include displays containing bulky and/or expensive materials which reduce the overall product display area. These displays may also incorporate horizontal shelving units which further limit the product display area due to their size and lack of adjustability for products of different dimensions. Additionally, these existing configurations may not be effective at automatically facing the product to increase visual appeal to consumers or add significant expense in order to provide such automatic front-facing (e.g., costs associated with additional materials required, costs associated with reduced amount of product that can be display due to the size of the front-facing systems used, costs associated with time and level of skill it requires for display setup, etc.).

Thus, a low-cost, adjustable product display and related methods of manufacture and display are desired which can be incorporated into existing retail areas. Such a system may additionally provide for automatic product facing for ease of re-merchandising product.

BRIEF DESCRIPTION OF THE DRAWINGS

The above needs are at least partially met through provision of the yogurt display and related methods described in the following detailed description, particularly when studied in conjunction with the drawings, wherein:

FIGS. 16A-B are perspective and front elevation views, respectively, of the friction reducing member of FIG. 15 albeit a longer version which covers a majority of the inner surface or region of the basket and preferably the entire length of the basket that stored product rests on;

Figure 1A:
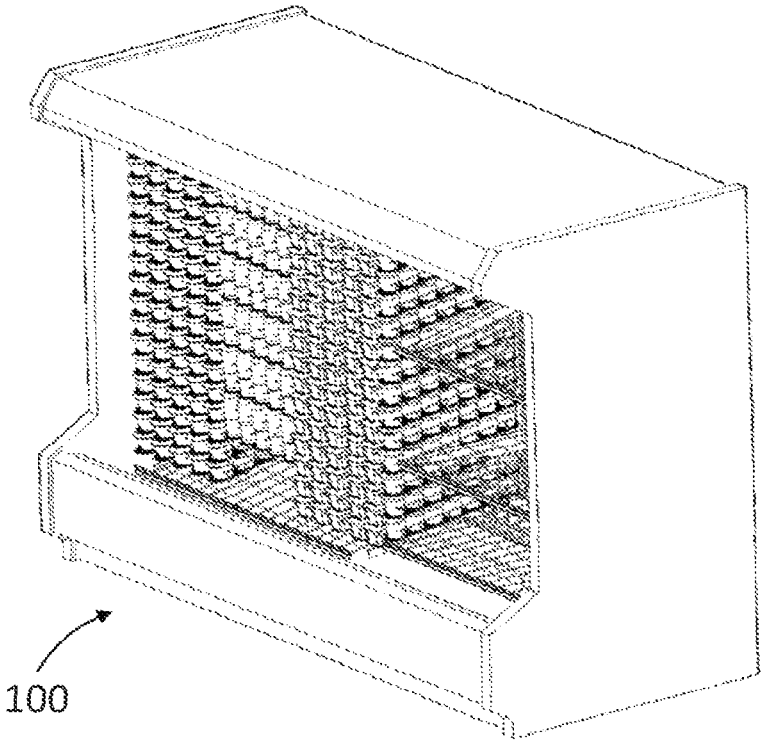
FIGS. 1A-B are perspective and front elevation views, respectively, of a product display as configured in accordance with various embodiments of the invention.
Figure 1B:
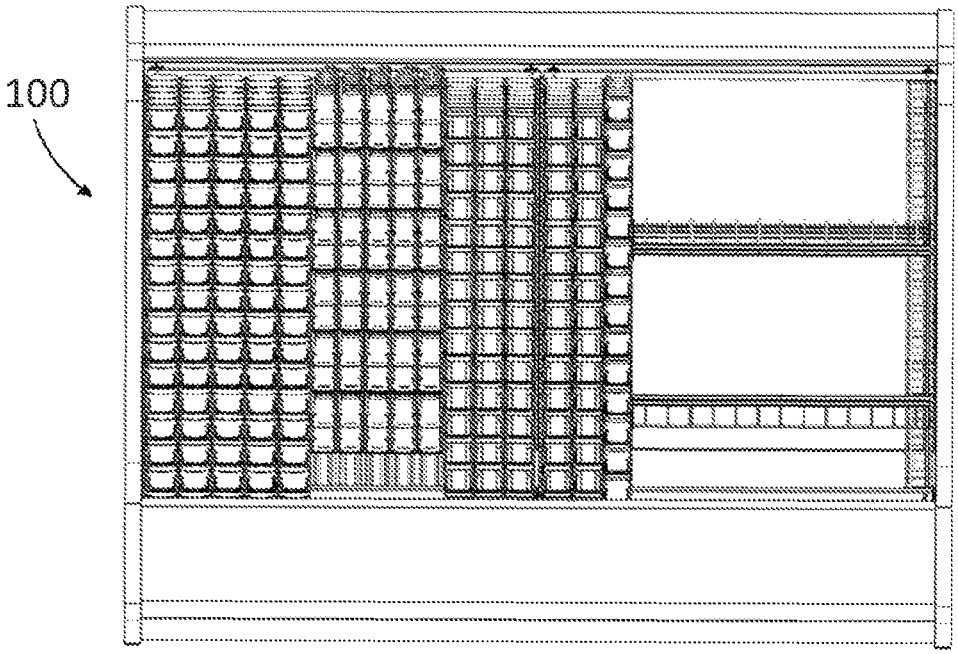

Corresponding reference characters indicate corresponding components throughout the several views of the drawings. Skilled artisans will appreciate that elements in the figures are illustrated for simplicity and clarity and have not necessarily been drawn to scale. For example, the dimensions and/or relative positioning of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments. It will further be appreciated that certain actions and/or steps may be described or depicted in a particular order of occurrence while those skilled in the art will understand that such specificity with respect to sequence is not actually required. It will also be understood that the terms and expressions used herein have the ordinary technical meaning as is accorded to such terms and expressions by persons skilled in the technical field as set forth above except where different specific meanings have otherwise been set forth herein. In addition, it should be understood that items that are set forth in the singular cover embodiments that utilize either one or more of such items.

DETAILED DESCRIPTION

Generally speaking, pursuant to these various embodiments, a basket type product display and related methods are herein presented. The basket product display includes top and bottom mounting assemblies, at least one vertical back rack, and a plurality of product display baskets extending laterally therefrom that mate with the vertical back racks. In some embodiments, a friction reducing component couples to the product display baskets to reduce friction between the product display basket and the product contained therein.

In one form, the basket product display includes a vertical bracket and a product basket configured to mount to the vertical bracket. In these embodiments, either the vertical bracket or the product basket is (or both are) configured to display a particular brand or manufacturer's product. In some embodiments, a plurality of product baskets are used to display a product.

In another form, both the vertical bracket and the product basket are configured to display a particular brand of product, manufacturer's product, or a particular class of product under a brand or manufacturer's product. For example, with respect to yogurt displays, the basket product display may be configured to display Greek yogurt, which may have a particular packaging, in one location of the display, a particular brand of yogurt having a different particular packaging in a second location of the display, and a particular manufacturer of yogurt having a different packaging in a third location of the display. Alternatively, the basket product display may be configured to only display one brand, manufacturer, or particular type of product.

In some embodiments, a friction-reducing insert is disposed within the product basket to reduce friction between the product basket and the product. The friction reducing insert may be constructed of a low-friction material, and may be configured to snap fit over a portion or portions of the product basket.

In still other embodiments, the product display further includes a price channel rotatably mounted to the product basket to display information about the displayed product. The price channel may be configured to be easily viewable and removable so as to assist in reading additional item information such as product stock numbers or barcodes.

The product basket may be colored to match a product, brand, or particular retail location. Color coding may be implemented to distinguish particular flavors from one another. Additionally, trade dress for a merchant may be mimicked so that consumers can quickly identify where their preferred product brand, manufacturer, or type is located within the display.

The product basket may also extend from the vertical bracket at a downward angle. Specifically, the particular downward angle may be measured for a particular brand, manufacturer, or type of product to provide an optimal gravity fed product basket, thus maintaining front faced appearance.

In some embodiments, a plurality of wire baskets are suspended from a rear wall. The plurality of wire baskets have side walls configured to contain a particular type of product to ensure movement of the product contained within the wire baskets is not interfered with by adjacent wire baskets or products disposed within the adjacent wire baskets.

Thus, in a preferred form, the vertical mounting bracket and baskets are configured for specific product or brands to maximize vertical pack-out of the product. Adjacent vertical brackets and baskets are similarly configured for specific brands so that horizontal pack-out is also maximized. Thus, the display disclosed herein comprises product specific shelving that allows retailers to maximize both vertical and horizontal pack-out and minimizes gaps or spacing between display products.

In addition to such apparatus, methods are also disclosed herein. For example, methods of displaying product are presented. One such method includes mounting a plurality of product or brand specific vertical brackets to a product display cooler and mounting a plurality of product or brand specific display baskets to the plurality of vertical brackets. The method may further include placing a plurality of products in the plurality of product display baskets.

These and other benefits may become clearer upon making a thorough review and study of the following detailed description. Referring now to the drawings, and in particular to FIGS. 1A-1B, 2A-2E, 3A-3E, & 4 an illustrative example of a yogurt display 100 that is compatible with many of these teachings may include a product 102, a top and bottom mounting assembly 120, 130, vertical back rack 150, and a product display basket 170. It is understood that the yogurt display 100 is configured to fit within existing retail coolers for ease of installation and display.

Figure 2A:
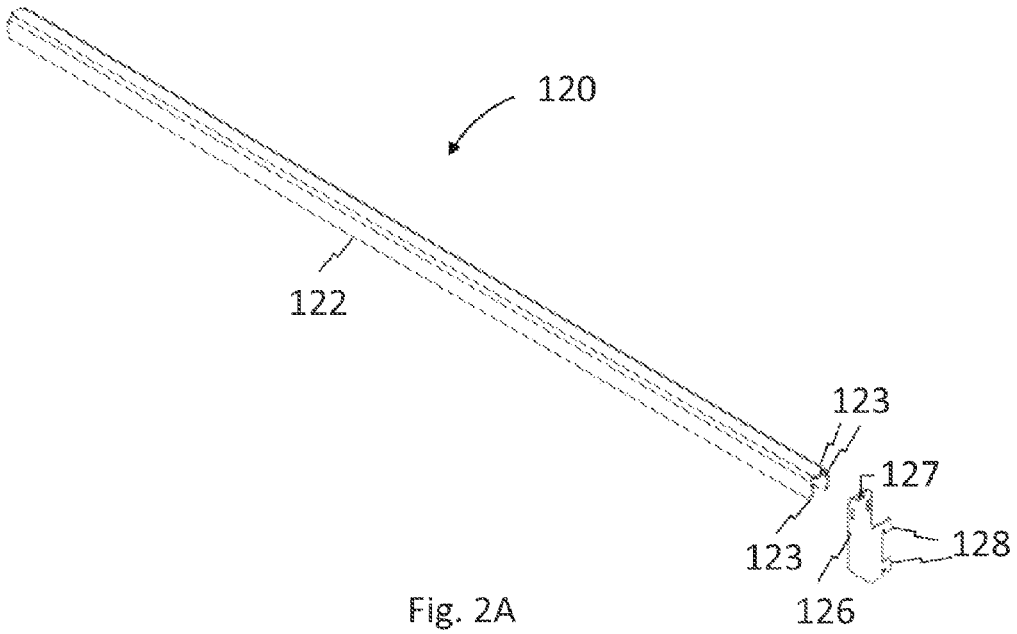
FIGS. 2A-B are partially exploded and perspective views, respectively, of a top mounting assembly of the product display of FIGS. 1A-B as configured in accordance with various embodiments of the invention.
Figure 2B:
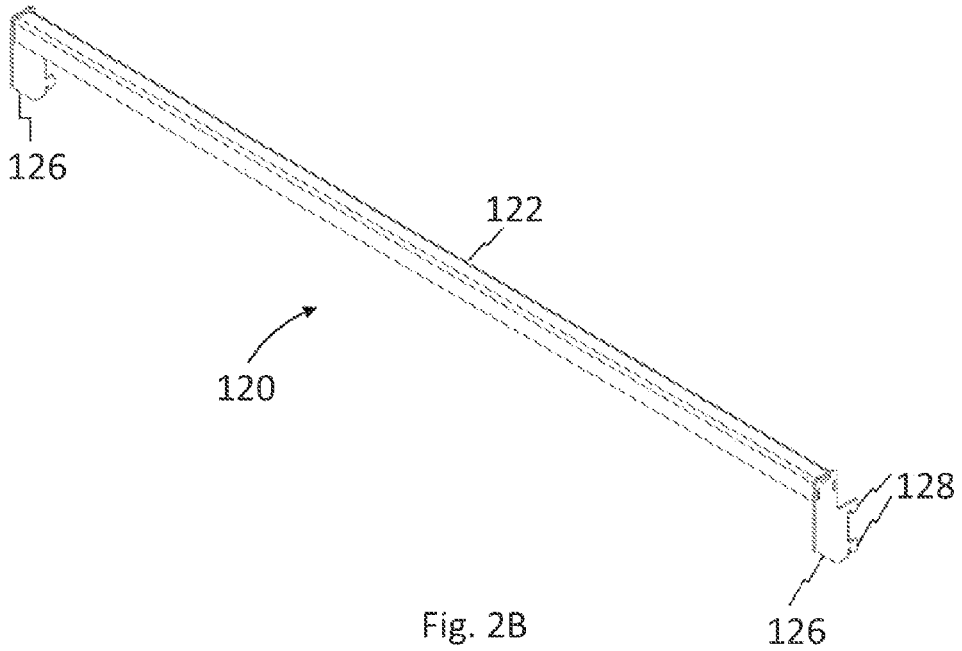
Figure 2C:
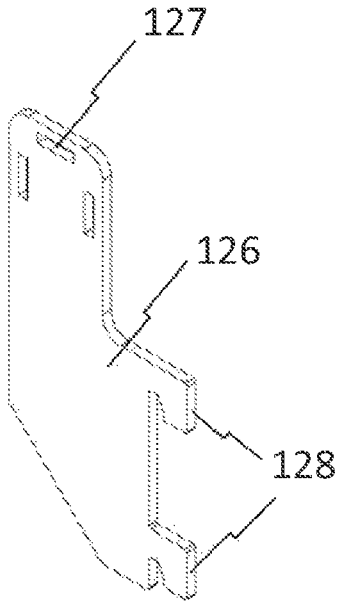
FIG. 2C comprises a perspective view of a top mounting bracket of the top mounting assembly of FIGS. 2A-B as configured in accordance with various embodiments of the invention.
Figure 2D:
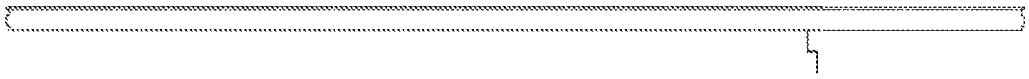
FIGS. 2D-E are top plan and right side elevation views, respectively, of the top mounting bar of the top mounting assembly of FIGS. 2A-B as configured in accordance with various embodiments of the invention.
Figure 2E:
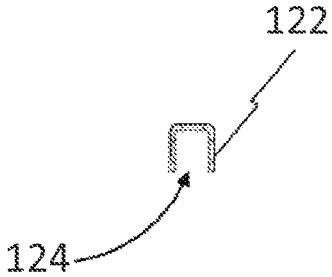

The top mounting assembly 120 includes a top or upper bar 122 and a top or upper bracket 126. As best seen in FIGS. 2A-2B, the top bar 122 includes tabbed protrusions 123 at opposing ends to be friction fit into slots 127 of the top bracket 126 to secure the assembly 120. In another embodiment, the tabbed protrusions 123 may be deformed after fitting into the slots 127 to create a permanent mounting assembly. Alternatively, the top bar 122 may be welded or fastened to the top bracket 126 using other conventional methods such as adhesives or fasteners such as screws, bolts, clasps, clips, etc. or the like. In an alternative embodiment, the top bracket 126 may be configured with tabbed protrusions to be inserted into slots in the top bar 122. The top bar 122 further includes a top channel 124.

The top bracket 126 further includes tabbed protrusions 128 which mate with vertical slots contained in the back wall of the display unit. It is understood that the mounting of brackets in this fashion is known by those having skill in the art, thus details of this configuration will not be discussed in further specificity other than to mention that the tabbed protrusions may be tapered so as to fit slots of different thickness or the bracket may be configured with a plurality of protrusions with each protrusion being intended to fit a particular slot thickness or size opening and/or configured to position the bracket 126 at a particular height with respect to the backwall.

Figure 3A:
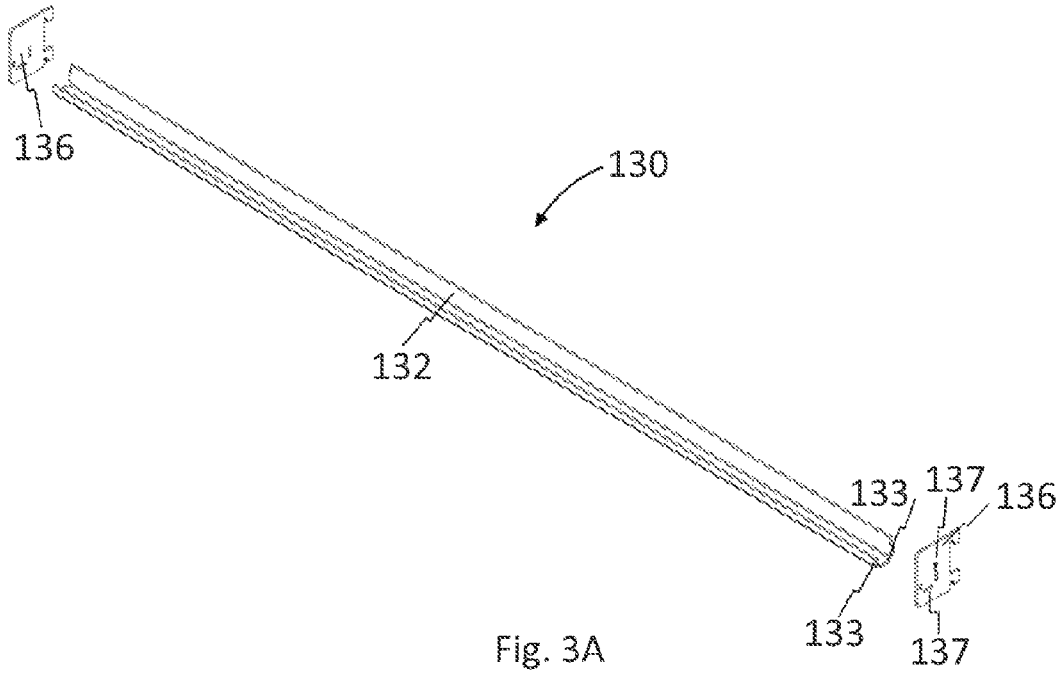
FIGS. 3A-B are exploded and perspective views, respectively, of a bottom mounting assembly of the product display of FIGS. 1A-B as configured in accordance with various embodiments of the invention.
Figure 3B:
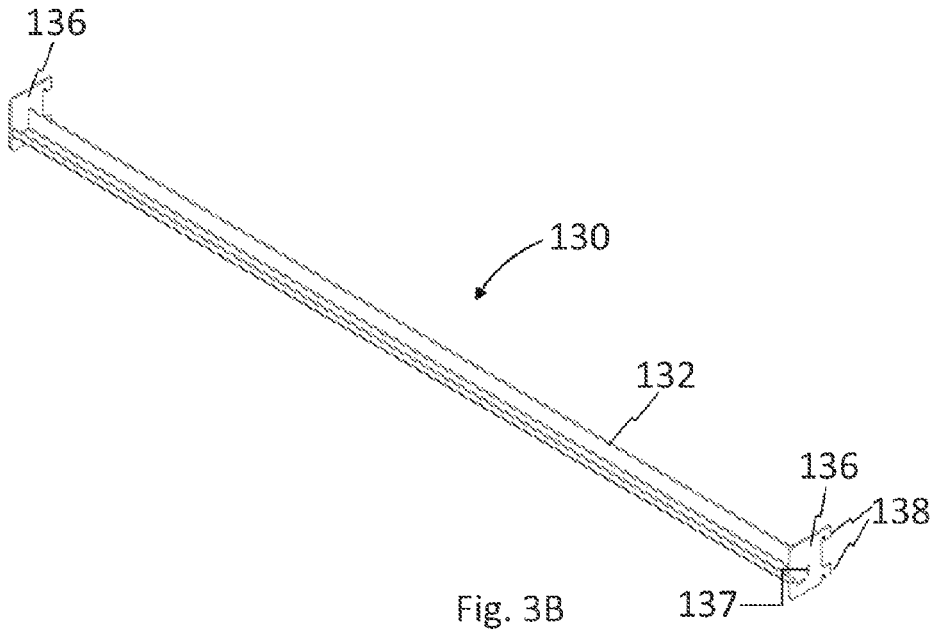
Figure 3C:
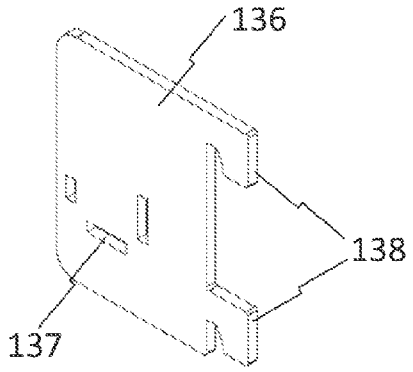
FIG. 3C comprises a perspective view of a bottom mounting bracket of the bottom mounting assembly of FIGS. 3A-B as configured in accordance with various embodiments of the invention.
Figure 3E:
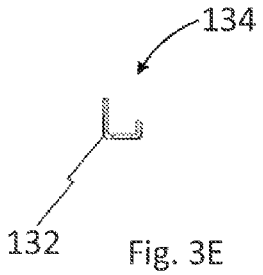
FIGS. 3D-E are top plan and right side elevation views, respectively, of the bottom mounting bar of the bottom mounting assembly of FIGS. 3A-B as configured in accordance with various embodiments of the invention.
Figure 3D:
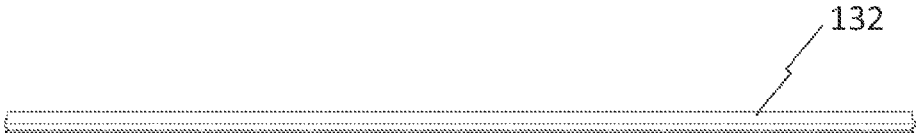
Figure 4:
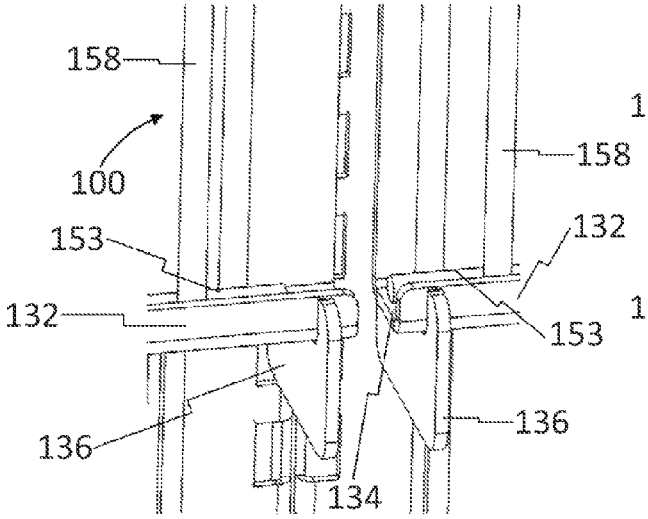
FIG. 4 comprises an enlarged partial perspective view of the bottom mounting assembly of FIG. 1 as configured in accordance with various embodiments of the invention illustrating alternative mounting brackets that may be used to connect two bottom mounting assemblies to one another so that vertical mounting brackets can be placed within the bottom mounting assemblies without requiring a gap from one bottom mounting assembly to the other.

Similar to the top mounting assembly 120, the bottom mounting assembly 130 includes a bottom bar 132 and a bottom bracket 136. As best seen in FIGS. 3A-3B, the bottom or lower bar 132 includes tabbed protrusions 133 at opposing ends to be inserted into slots 137 of the bottom or lower bracket 136. In an alternative embodiment, the bottom bracket 136 may be configured with tabbed protrusions to be friction-fit into slots in the bottom bar 132. Alternatively, the bottom bar 132 may be configured in a similar manner as the top bar 122, thus the protrusions 133 may be deformed after being inserted into the slots 137 to create a permanent bottom mounting assembly. The bottom bar 132 may alternatively be secured to the bottom bracket 136 through welding, the use of adhesives, bolts, or other conventional methods. In some embodiments, the bottom bar 132 further includes a bottom channel 134. The bottom bracket 136 further includes tabbed protrusions 138 which mate with the previously mentioned vertical slots contained in the back wall of the display unit. FIG. 4 illustrates the mounting of the bottom assembly 130 to the back wall of the display unit.

The top and bottom bars 122, 132 are appropriately dimensioned to fit a desired product display. In one illustrative example, the top and bottom bars have a length of approximately forty-seven inches (47") to fit conventional open air refrigeration units used by most retailers. It will be appreciated that the top and bottom bars 122, 132 may be a shorter or longer length to appropriately mount to the desired back wall of the display unit or to fit application specific refrigeration units.

As seen in FIGS. 5A-5C & 6A-6E, a vertical back or mounting rack 150 is shown. In a preferred embodiment, the vertical back rack 150 is constructed of bent tubular metal (solid or hollow) and includes a top end 151, bottom end 152, a plurality of mounting bars such as horizontal bars or rungs 153, and a plurality of support bars 158. In an alternative embodiment, the vertical back rack 150 is constructed of a flat metal or other conventional materials. The vertical back rack 150 mounts to the top and bottom mounting assemblies 120, 130 by inserting the top end 151 into the top channel 124 of the top bar 120 and raising the vertical back rack 150 into the top channel 124 until the bottom end 152 may be inserted into the bottom channel 134 of the bottom bar 130. The top and bottom ends 151, 152, of the vertical back rack 150 are thus constrained within the top and bottom channels 124, 134 therefore preventing outward movement and/or accidental removal of the vertical back rack 150, but the vertical back rack 150 may freely move laterally within the top and bottom channels 124, 134.

Figure 5A:
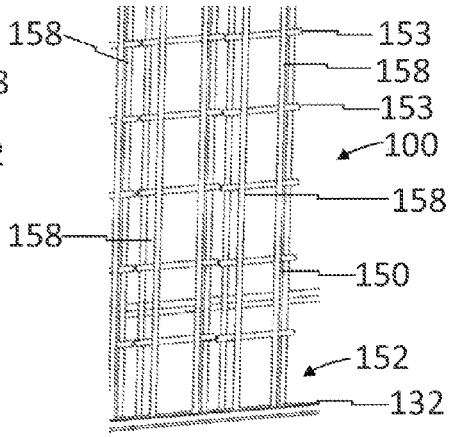
FIGS. 5A-C are partial perspective views of a vertical mounting bracket of the product display of FIGS. 1A-B as configured in accordance with various embodiments of the invention, with FIG. 5A illustrating a partial perspective view of the bottom of the vertical mounting bracket disposed in the bottom mounting assembly, FIG. 5B illustrating a partial perspective view of the upper of the vertical mounting bracket disposed in an upper mounting assembly, and FIG. 5C illustrating a partial perspective view of a the bottoms of a plurality of vertical mounting brackets disposed in the bottom mounting assembly and including an optional stabilizer member interconnecting the plurality of vertical mounting brackets.
Figure 5B:
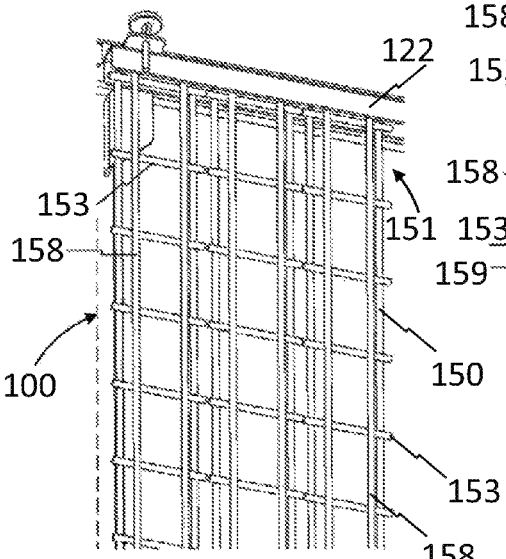
Figure 5C:
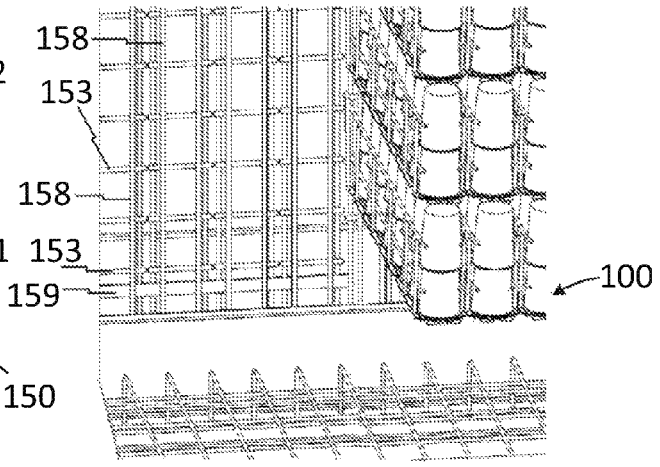
Figure 6A:
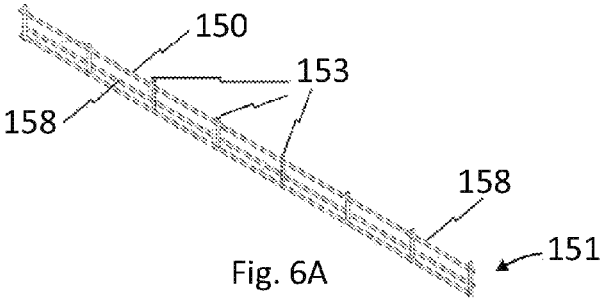
FIG. 6A comprises a perspective view of a vertical mounting bracket of the product display of FIGS. 1A-B as configured in accordance with various embodiments of the invention.
Figure 6B:
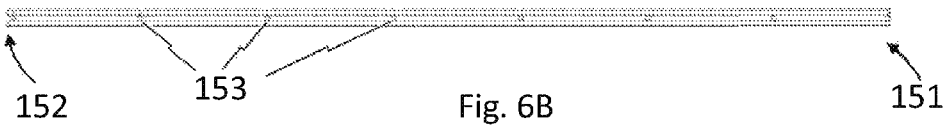
FIGS. 6B-E are right side elevation views of exemplary vertical mounting brackets of the product display of FIGS. 1A-B as configured in accordance with various embodiments of the invention, with FIG. 6B illustrating the spacing of lateral bars on the vertical mounting bracket for a first brand of product with a first size or shape, FIG. 6B illustrating the spacing of lateral bars on the vertical mounting bracket for a second brand of product with a second size or shape different than the first size or shape, FIG. 6C illustrating the spacing of lateral bars on the vertical mounting bracket for a third brand of product with a third size or shape different than the sizes or shapes for the first and second brands, and FIG. 6E illustrating the spacing of lateral bars or rungs on the vertical mounting bracket for a fourth brand of product with a fourth size or shape different than the sizes or shapes for the first, second and third brands.
Figure 6C:
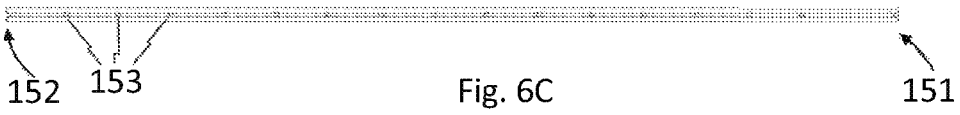
Figure 6D:
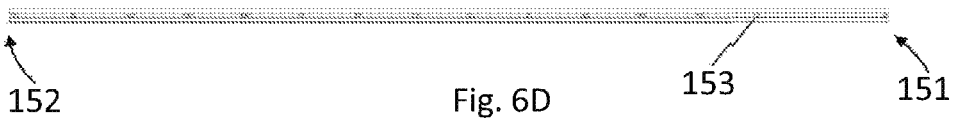
Figure 6E:
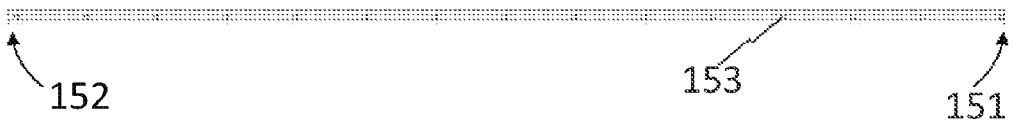

As seen in FIG. 5C, a stabilizing member 159 may be used to provide increased stability to a plurality of vertical back racks 150. In the form illustrated the stabilizing member 159 snakes between support bars 156 to reduce movement of the vertical back racks 150. Thus, the individual vertical mounting brackets 150 are interconnected to one another in such a way as to prevent the display from wobbling or wiggling or individual mounting brackets 150 from moving independent of the others. In alternate forms, other types of stabilizing members or brackets may be used to interconnect the vertical mounting brackets 150, such as fasteners (e.g., bolts, clips, clasps, etc.). It should also be understood that in still other embodiments, the vertical brackets may be fastened together such as by welding to provide an integral back wall or mounting bracket configuration. For example, in alternate forms where the vertical mounting brackets are made out of flat sheet metal, the entire rear wall made up of the vertical mounting brackets could be stamped or pressed from a single sheet of metal.

The mounting bars 153 are spaced to provide ample, yet minimal, clearance for products to be displayed having varying heights. With respect to the yogurt example, manufacturers of specific yogurt products or brands typically utilize identically-sized product containers across different flavors within a brand or product line, but competing yogurt brands and manufacturers utilize varying product sizes. Upon determining product dimensions for a particular brand or manufacturer, the mounting bars 153 may be secured to the support bars 156 at appropriate intervals to provide the minimum vertical clearance necessary to allow product display baskets 170 to mount thereto as discussed in further detail below. The mounting bars 153 may be secured to the support bars 156 by any type of fastener, such as welding, adhesive, rivet, bolt and nut, screw, snap-fitting, tongue and groove or mortise and tenon, or similar methods or, in alternative forms, may be made from a unitary piece of material (e.g., stamped, pressed, molded, forged, etc.). The ability to fine tune the intervals of the vertical mounting bars 153 maximizes the amount of product which may be displayed along a column and specifically, the vertical pack-out of product. FIGS. 6B-6E illustrate several example intervals of mounting bars 153 based on yogurt products 102 having varying dimensions. As seen in FIG. 5C, vertical back racks 150 having mounting bars 153 spaced at varying intervals are provided.

In one embodiment and as seen in FIG. 4 a mounting bar 153 is provided at an extreme lowermost position partially inside of the bottom channel 134 of bottom mounting assemblies 132 to form a base or bottom of the vertical upright or back racks 150. Due to the open ended or U-shaped configuration of the bottom bracket 136 and/or mounting assemblies 132, a mounting bar 153 may be placed such that it traverses the gap from one bottom bracket 136 to the next, thus allowing additional product display baskets 170 to be utilized in this area where size constraints previously restricted products from being displayed. The open ended or U-shape of bracket 136 further allows vertical uprights or back racks 150 to be positioned directly to the end or distal edge of bracket 136 or even beyond to ensure that all available space within the display can be utilized for uprights 150 and their associated baskets in order to improve (if not maximize) the pack-out that can be achieved within the display (e.g., allowing for vertical and/or horizontal pack out to be improved, if not maximized). More particularly, FIG. 4 illustrates mounting brackets in accordance with one embodiment of the present invention that may be used to connect or align two bottom mounting assemblies to one another so that vertical mounting brackets 150 can be placed within the bottom mounting assemblies 132 without requiring a gap from one bottom mounting assembly to the other or from one vertical bracket 150 to another. Thus, brackets 150 may be positioned proximate or adjacent to one another to eliminate any wasted space between brackets 150 and their associated baskets to improve the pack out of the display.

Conventional cooler units in the market place often have lower mounting assemblies or bar channels that come in predetermined lengths of thirty, thirty-six, forty-eight and sixty inches (30", 36", 48" and 60") and with mounting brackets that block the ends of the mounting assemblies or bar channels. Thus, displays configured for use with such conventional systems are limited in how wide the display can be setup based on the amount of shelving that can be placed within the allotted space available in the mounting assemblies or bar channels (e.g., within the 30", 36", 48" or 60" mounting assemblies, depending on which is used). Unfortunately, this often means that a portion of the mounting assembly or bar channel cannot be used because it is not wide enough to fit further shelving or shelving sections. In addition, a gap is forced to be present between adjacent mounting assemblies or bar channels because of the closed ends of each. These concerns are eliminated by the embodiments disclosed herein in that the open-ended U-shaped configuration of mounting assemblies 132 and mounting brackets 136 allow for an uninterrupted channel 134 to be formed from one mounting assembly 132 to the next that the vertical uprights or support brackets 150 may be positioned within to take advantage of the entire length of the mounting assemblies 132 and/or the available width within the cooler unit. With this configuration, vertical support brackets 150 may be positioned such that they traverse the gap between adjacent mounting assemblies 132 and/or such that they extend beyond the end of the mounting assembly 132 if the application allows for this to be done. Thus, the illustrated display allows the horizontal pack out of the display to be improved, if not maximized, and allows the mounting assemblies 132 to be positioned within the display or application (e.g., cooler) adjacent one another so that a continuous mounting assembly channel 132 is formed from one mounting assembly bracket 132 to another.

Figure 7:
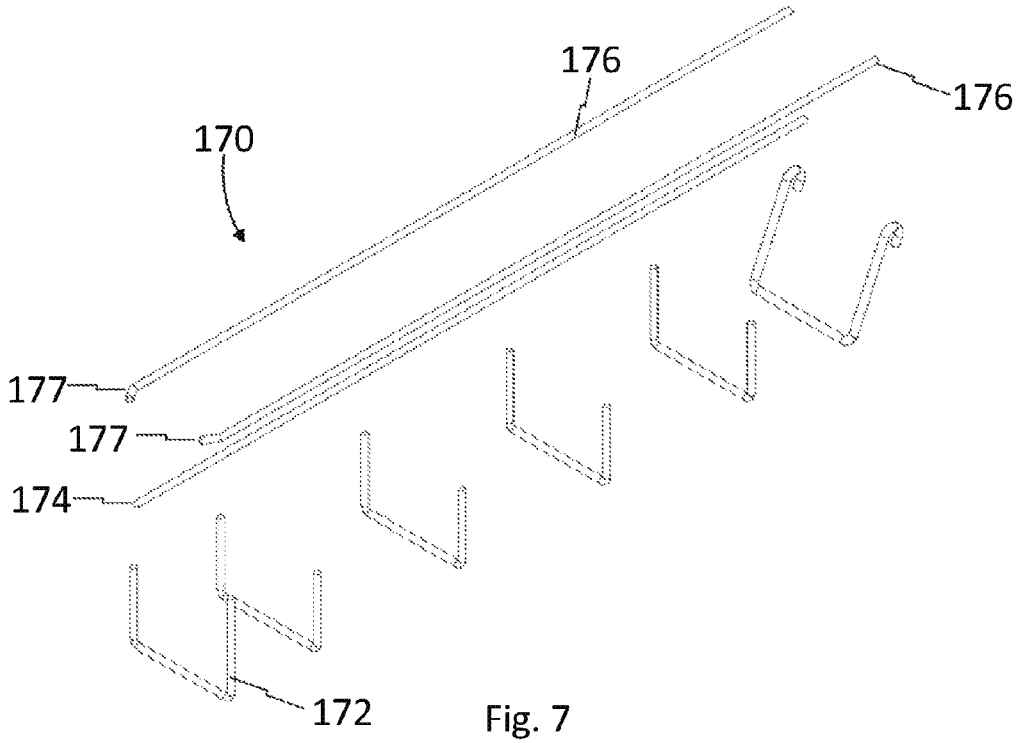
FIG. 7 comprises an exploded perspective view of a product basket of the product display of FIGS. 1A-B as configured in accordance with various embodiments of the invention.

FIG. 7 illustrates a product display basket 170 in accordance with one aspect of the invention. In a preferred embodiment, the product display basket 170 is constructed of bent tubular metal (e.g., wire). As with the mounting brackets 150, it is understood that in alternative embodiments, the product display basket 170 may be constructed of a flat metal or other conventional materials. The product display basket 170 includes a plurality of supports or support braces such as U-bars 172, a base, such as center runner or bar 174, and a plurality of side members, such as side bars 176. The individual components of the product display basket 170 may include a colored coating, such as a color coating or insulation, to increase visual appeal of the display when installed in the retail location and/or to match a particular color scheme or trade dress of a specific brand of product to be displayed, manufacturer of product and/or of a particular retailer within which the display will be used. The individual components of the product display basket 170 may be secured together by welding or similar conventional fastening or securing methods. Although it has been described how to make the baskets out of wire, it should be understood that in alternate forms, the baskets may be made from sheet metal using a stamping or pressing process, or from plastic or metal using a molding process.

The center runner 174 is affixed to the U-bars or support braces and provides a surface which aligns the product and guides the product through its movement within the basket and/or a surface which the product rests and slides on. In a preferred configuration, a single center runner 174 is used as the base in the display basket 170 so as to provide fewer surfaces for a product to be impeded by during movement within the display basket 170. The center 174 provides an inexpensive lower surface as opposed to a flattened floor surface used in conventional spring-loaded displays, thus further minimizing manufacturing costs and friction generated between the displayed products and the display or display baskets 170. In an alternate embodiment, a plurality of runners may be used and positioned at laterally offset distances within the product display basket 170. In still other forms, the basket may be designed with a flat floor or have a friction reducing insert (as will be discussed further later on in this document).

Figure 8A:
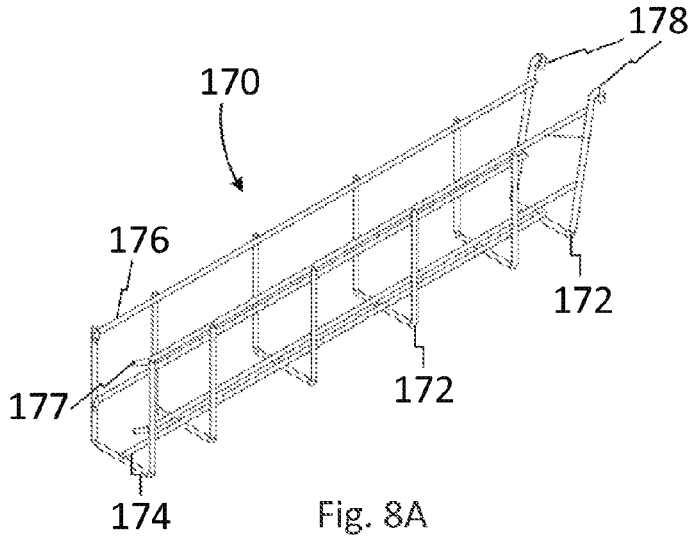
FIGS. 8A-C are perspective, right side elevation, and front elevation views, respectively, of a product basket of the product display of FIGS. 1A-B as configured in accordance with various embodiments of the invention with the basket being configured to display a first brand of product with a first size and shape.
Figure 13:
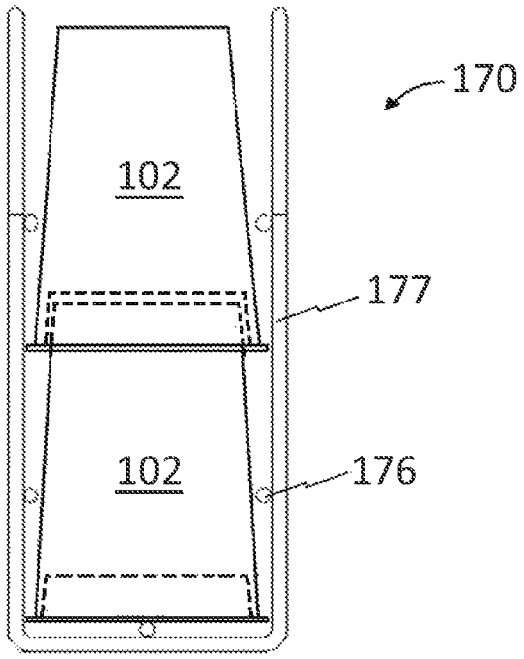
FIG. 13 is a front elevation view of a product basket containing a product as configured in accordance with various embodiments of the invention with the basket displaying multiple rows of product (e.g., in this case, double stacked product)

The baskets 170 will include side members, such as side bars 176, and in a preferred form will include a plurality of side bars 176 with at least one side bar positioned on opposite sides of the basket 170 and the product to be display. The plurality of side bars 176 are affixed to the U-bar 172 near the top or distal end of its generally vertical legs and serve as dividers between adjacent products 102 as well as a guide for the product 102 contained within the display basket 170 so as to reduce lateral movement therein. More particularly, the outer edge of the U-shaped braces 172 may be used to abut adjacent baskets in order to ensure proper spacing between baskets so that portions of the displayed product from one basket do not interfere with portions or the displayed product from another basket (or so that portions of the displayed product and/or basket of one product do not hinder movement of displayed product in a neighboring or adjacent basket). In some embodiments, and as seen in FIGS. 8A and 13, four or more side bars 176 may be employed to house products 102 which are vertically nested or stacked in a single product display basket 170 while still providing sufficient lateral support.

The ends of the plurality of side bars 176 may include bell-mouth shaped fingers, tongues, or protrusions 177 extending laterally inwards which serve to restrict unintended movement (e.g., removal) of product 102 contained within the product display basket 170 (e.g. such protrusions 177 may serve as an end stop). The fingers 177 are configured to allow product 102 to be removed and replaced by consumers or retailers, while minimizing the ability of the product 102 to unintentionally slide out of the product display basket 170. In a preferred embodiment, the fingers 177 are generally rigid and non-flexing, thus it is understood that the product 102 must be generally deformable or have generally deformable packaging so as to allow a user to remove the product from the display basket 170 by pulling it through the fingers 177.

Although the product display baskets discussed above describe side bars having rigid or non-flexing fingers 177, thus requiring the product or product packaging to be deformable, in an alternative embodiment, the fingers 177 of the side bars are flexible to be used with product having non-deformable packaging as described in U.S. Pat. No. 7,854,333, issued to Kottke et al. on Dec. 21, 2010, the contents of which are fully incorporated herein by reference in their entirety.

The rearmost U-bar or brace 172 includes a pair of mounting or hanging members, such as hooks 178, extending from the top of the vertical legs which are configured to mount on the mounting bars or lateral rungs 153 of the vertical back racks or mounting bracket 150 by placing the hooks 178 over the mounting bars 153. In the form illustrated, the mounting members 178 are formed integral to the rearmost mounting bracket or U-shaped brace 172. In alternate embodiments, however, it should be understood that the mounting members 178 could be formed as one or more mounts instead of a pair (e.g., one mounting member, three mounting members, etc.) and that the mounting members 178 may alternatively be formed from a separate piece or pieces which in turn are connected to the rearmost mounting bracket or U-shaped brace 172 instead of being formed integral therewith. In still other forms, the mounting members 178 may be configured to connect to another portion of the product display basket besides the rearmost mounting bracket 172 if desired. For example, in some forms the mounting members 178 may be connected to side members 176, base member 174 and/or an insert connected to base member 174.

The rearmost U-bar 172 may also be configured to be angled relative to the other U-bars 172 which are generally arranged parallel to one another. By affixing the rearmost U-bar at an angle, when mounted to the vertical back rack 150, the product display basket 170 will extend from the vertical back rack 150 at a downward angle, thus creating a gravity fed product display basket 170 which assists in the automatic facing of products 102. In some embodiments, the angle of the rearmost U-bar 172 is determined based on a particular product, brand, or manufacturer to provide an optimal angle for gravity feeding the product 102. Thus, in a single display, baskets may be suspended at different angles to either provide for optimal gravity feed dispensing of product and/or to maximize vertical and/or horizontal pack-out. It is understood that in some embodiments, the rearmost U-bar 172 may be configured generally parallel to the other U-bars 172, and thus the product display basket 170 will extend horizontally outwardly. In such configurations, a spring biased pusher assembly may be added to the basket to front face product as desired using conventional pusher technology.

As with the mounting bars 153 of the back racks 150, dimensions of the product display baskets 170 are determined based on the size and shape of the product intended to be displayed (e.g., sizing of a particular brand or manufacturer's product container, etc.) and/or the size and shape of any additional display component dimensions (e.g., such as the size of a cooler the vertical supports 150 and baskets 170 will be installed in). Thus, in forms of the display intended to display yogurt, the width and height of the U-bars 172, 178 and the length of the center bar 174 and side bars 176 may be determined based on the circumference of the yogurt container's base and the container's lip configuration which is the widest most part of the product packaging where the product packaging is typically sealed, but sometimes can be located elsewhere on the product away from the seal. Specifically, the width of the U-bars 172 may be configured to be slightly greater than the width of the particular brand's container base so as to restrict lateral movement of the container within the product display basket 170. Furthermore, some brands' products 102 include a lip or ledge at the top of the container. Thus, the height of the U-bar 172 and placement of the side bars 176 may be configured to be spaced slightly below this lip or ledge and thus may be configured to serve as an additional guide for the product 102. In a preferred form, the lip does not rest on the side bars so as to prevent adding friction between the product and the basket display, but in alternate embodiments where this is desired, the basket could be designed so that the lip could rest on the side bars. FIGS. 8A-8C, 9A-9C, 10A-10C, and 11A-11C provide illustrative examples of different product display basket 170 dimensions which may be suitable for various brands. It is understood that these figures are for illustrative purposes only and exact dimensions may vary from those provided in the figures.

Generally, the product display basket 170 is configured to be longer than it is wide so as to take advantage of the depth of conventional refrigeration or cooler units. Exactly how long will be determined by the depth of the cooler unit that the baskets 170 and support brackets 150 are installed or disposed in. For example, if an application includes a deeper cooler, then the length of the baskets 170 may be extended to take advantage of the cooler's additional depth and improve pack out in this regard. If the cooler is shallower, then the length of the baskets 170 may be made shorter to accommodate the smaller depth of the cooler. In addition, if the cooler is taller, the vertical brackets 150 may be lengthened to take advantage of the additional height of the display and possibly allow for more rows of baskets to further improve vertical pack out of product. Conversely, if the cooler (or display application) calls for shorter brackets 150, then the brackets can be made smaller to accommodate this need. This flexibility illustrates one key feature of the invention disclosed herein, which is that the baskets 170 and brackets 150 not only can be configured for specific product being displayed, but also can be configured for the specific application intended for the baskets and brackets sets. This too illustrates another benefit of the wire configuration depicted in the exemplary embodiments herein, in that the size and/or shape of the wire baskets and brackets can easily be altered to take advantage of the specific application the display is intended for (whether that be product being displayed or environment the display will be used in).

Figure 12A:
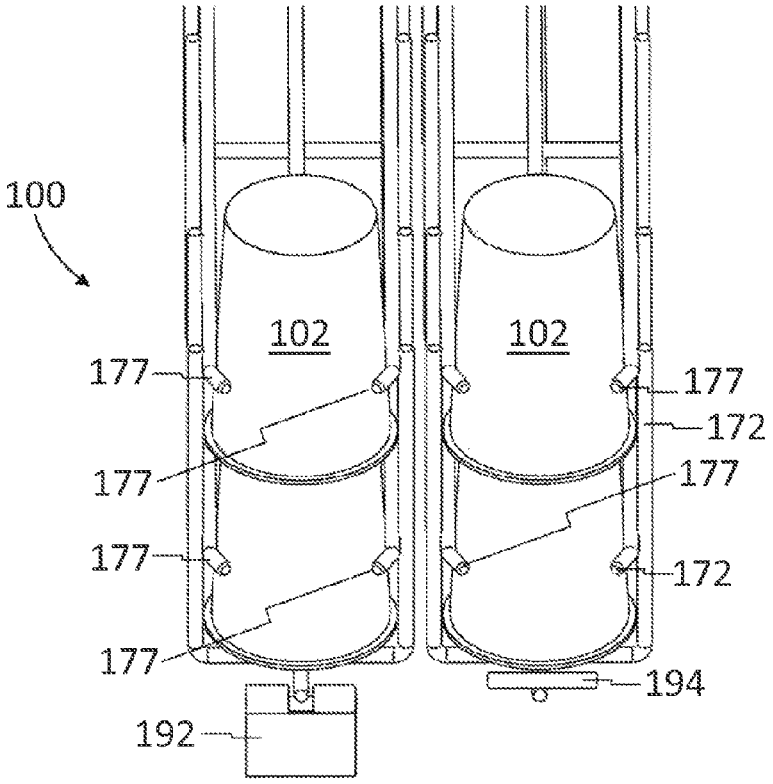
FIGS. 12A-B are enlarged perspective views of the product baskets of the product display of FIGS. 1A-B as configured in accordance with various embodiments of the invention, with FIG. 12A illustrating a first brand of product with a first size or shape and two different types of price channel cross-bars or members with one extending from below a center channel wire and the other extending from above a center channel wire with the latter further serving as a product stop to prevent product packing at the distal end of the basket from accidental removal from the basket, and FIG. 12B illustrating a second brand of product with a second size or shape different from the size or shape of the first brand and a third location for placement of a price channel.
Figure 12B:
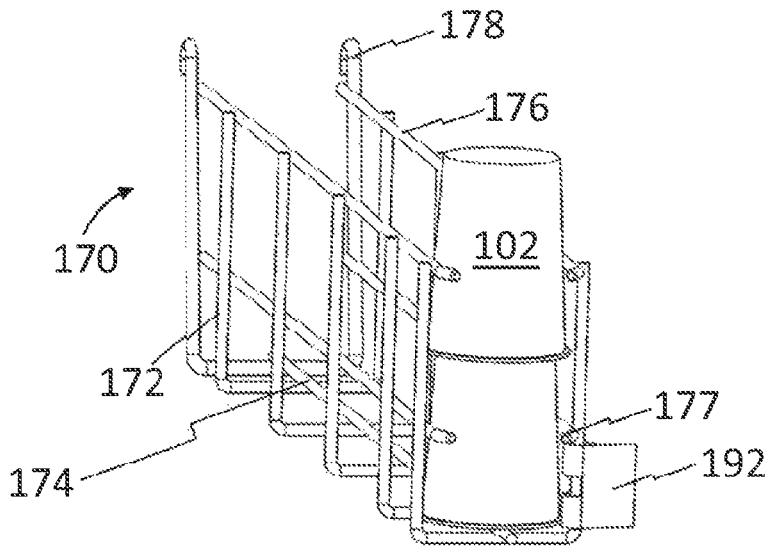

So configured, different product display baskets 170 may be utilized for a large number of differently sized products 102. By providing a customized vertical back rack 150 with mounting bars 153 being spaced at appropriate intervals and product display baskets 170 having U-bars 172 with appropriate heights, maximum vertical product density may be obtained for the display, thus allowing retailers to maximize vertical product spacing or pack-out in their existing refrigeration units as well as new refrigeration units. Additionally, due to the customized width of the U-bars 172 and thus the product display baskets 170, maximum horizontal product density may be obtained, thus allowing retailers to maximize their horizontal product spacing or pack-out in their existing refrigeration units as well as new refrigeration units. As seen in FIGS. 12A & 12B, horizontal space between adjacent products 102 is greatly reduced.

To load the product display baskets 170 with product 102, the retailer may top load individual products 102 into the product display basket 170, or alternatively may push the product through the fingers 177 and into the product display basket 170. Remerchandising of removed product may also be accomplished by either top loading or pressing the product through fingers 177, however, in a preferred form the latter will be used more commonly than the former due to the desire to allow the display to improve or maximize horizontal and vertical pack out meaning that top loading will likely not be possible when all the baskets 170 are installed on the vertical uprights or mounting brackets 150. In use, the baskets 170 could be individually pulled out and top loaded and then reinstalled onto the display, or top loaded before installed on the display starting with the lowest row of baskets and progressively adding rows up from there if desired.

In some embodiments, the product display baskets 170 include product information display or mount, such as price channel 192, configured to display pricing and other product information. The price channel 192 is rotatably mounted to a mounting member, such as cross bar or member 194 attached to the end of the center bar 174. As seen in FIG. 12A, in some embodiments, the bar 194 is mounted to the top side of the center bar 174, and in other embodiments, the bar 194 is mounted to the bottom side of the center bar 174. In either case, the price channel is rotatable about a horizontal axis. Having the cross bar 194 mounted on top of the center channel runner may be preferred in situations where it is desired to have the cross bar member 194 assist with retaining product within the basket and preventing or hindering inadvertent removal. For example, in some forms, the cross bar 194 may block the bottom of the product from sliding out of the basket much like protrusions 177 do, so that the product has to be lifted up over the cross bar 194 to be removed. In other embodiments and as seen in FIG. 12B, the price channel 192 is rotatably attached directly to the forward most or front most U-bar 172 in a vertically-mounted manner so as to be rotatable about a vertical axis. It should be understood that when using the terms forward most or front most and the like, in alternate embodiments the specific feature does not have to be the forward most or front most item, but rather could simply be positioned in a forward or front portion if desired. The same is true for rearward most or rear most.

The baskets described herein may include an airflow directing member, such as liner or sleeve 182, for directing refrigerated or conditioned air along a basket to cool product therein and/or product in other portions of the display (e.g., other adjacent baskets, etc.). For example, in the open air refrigeration unit illustrated in FIGS. 1A-B, airflow directing members such as liner 182 in FIGS. 14A-B may be used to force colder air to flow through each basket more efficiently (e.g., requiring chilled air to flow all the way from one end of the basket to the other, rather than dispersing before getting through the entire basket). Thus, liner 182 helps maintain a more uniform temperature throughout each basket and the display as a whole. In the form illustrated in FIGS. 14A-B, the liner comprises two thin, L-shaped sleeves that extend from respective side rails or wires down toward the center channel 174. The side rails and center channel wires extend inward toward the inner region of the basket beyond the liner 182 so that product continues to move through the basket as discussed above without the liner 182 interfering with this movement. In a preferred form, the liner is made of a flat plastic material and is snap-fit or friction fit into position between the side rail and center wires so that the liner can easily be wiped down or removed and cleaned if needed. As discussed with other embodiments herein, the liner may be colored or provided with indicia or marking to match a particular applications color scheme/trade dress or utilize marks/trademarks desired for that particular application (e.g., matching a store's trade dress, matching a particular product brands trade dress, matching a color scheme associated with a particular type of product but not a specific brand, etc.).

Figure 15:
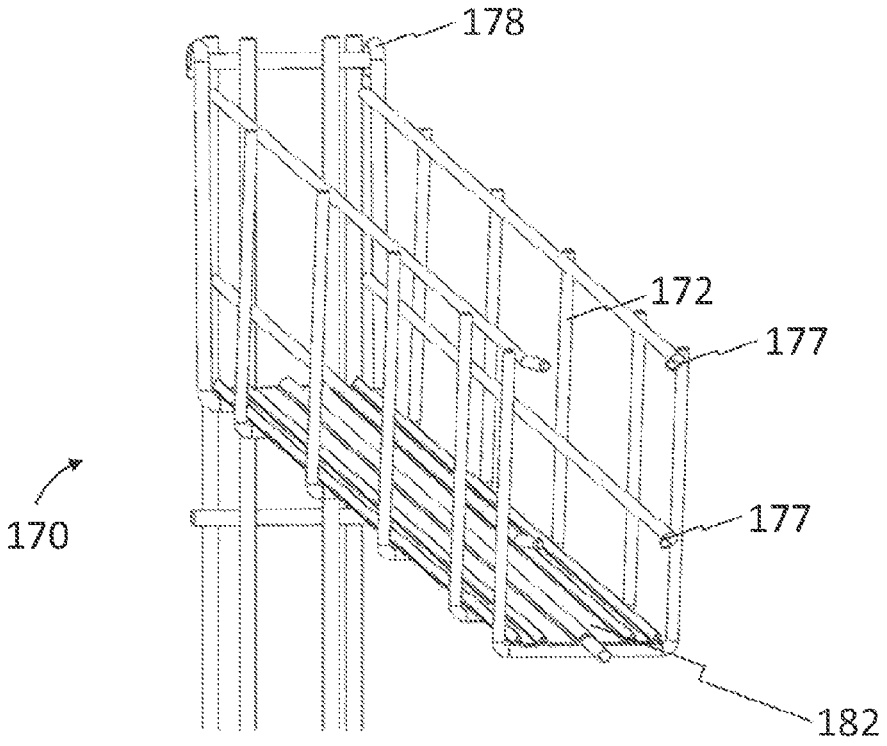
FIG. 15 is a perspective view of a product basket in accordance with another embodiment of the invention illustrating an alternate member that directs airflow and also serves as a friction reducing member disposed on an inner surface or region of the basket (e.g., in this case, on the center channel runner or wire) to assist with dispensing of product via the basket.

In alternate forms, the airflow directing member may be integrated into a friction reducing component used to assist product movement through the product display. In the form illustrated in FIGS. 15-16B, a friction-reducing component 182 is inserted or disposed into the product display basket 170 to allow the product (not shown) to more easily move to the front of the product display basket 170. In some embodiments, the friction reducing component 182 is an elongated sheet of plastic injected with silicone or other similar low-friction materials. The elongated sheet may include a center channel which allows the insert 182 to be friction fit or snap fit to center runner 174. Alternatively, the friction-reducing component may be secured to the vertical portions of the U-shaped braces 172 via friction or snap fit recesses, or through adhesives, fasteners or other similar securing methods. In an alternative embodiment where multiple runners are incorporated on the basket, the friction-reducing component may include multiple channels for friction fitting or snap fitting the plurality of runners. In still other forms, the U-shaped braces 172 may be formed with a protrusion or shoulder near the bottom of the vertical portion of each U-shaped brace to allow the insert to be pressed down beyond or below the shoulder and into the bottom of each basket to retain the insert in a desired position.

Figure 14A:
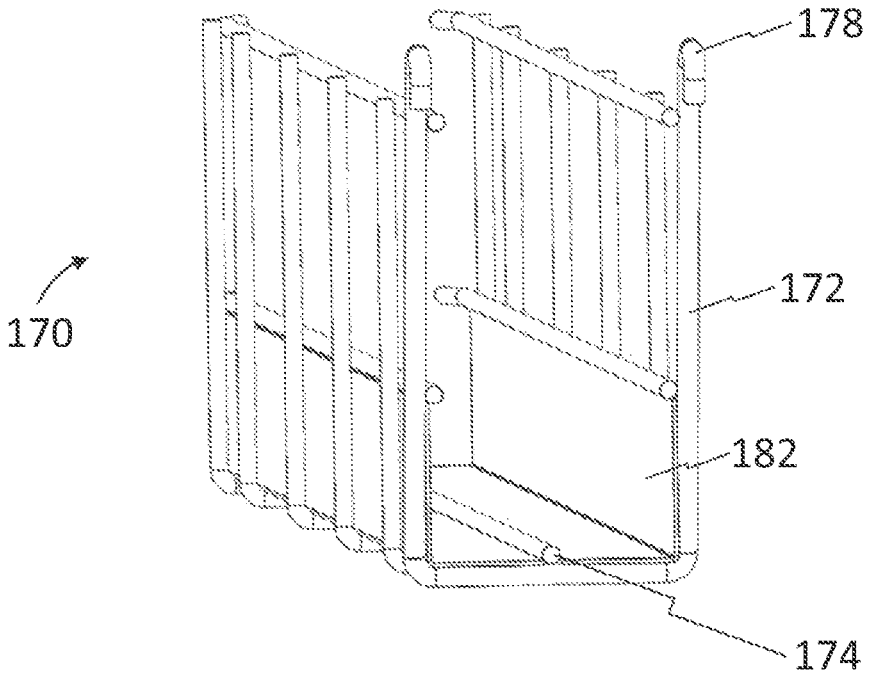
FIGS. 14A-B are rear and front perspective views, respectively, of an exemplary product basket in accordance with an embodiment of the invention, with the basket having an airflow directing member such as a liner or sleeve for directing refrigerated or conditioned air along a basket to cool product therein and/or product in other portions of the display (e.g., other adjacent baskets, etc.)
Figure 14B:
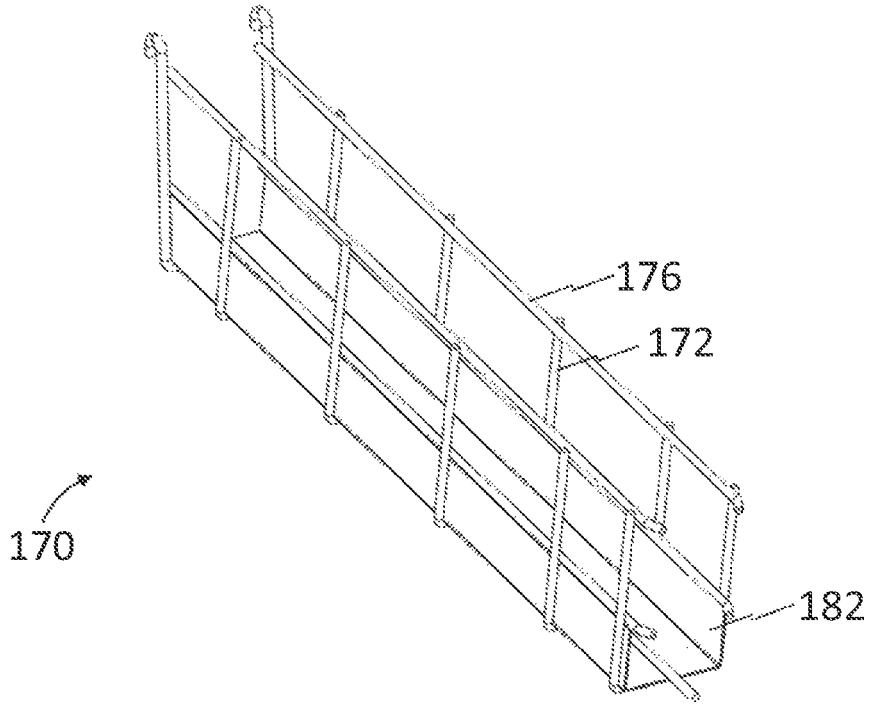
Figure 16A:
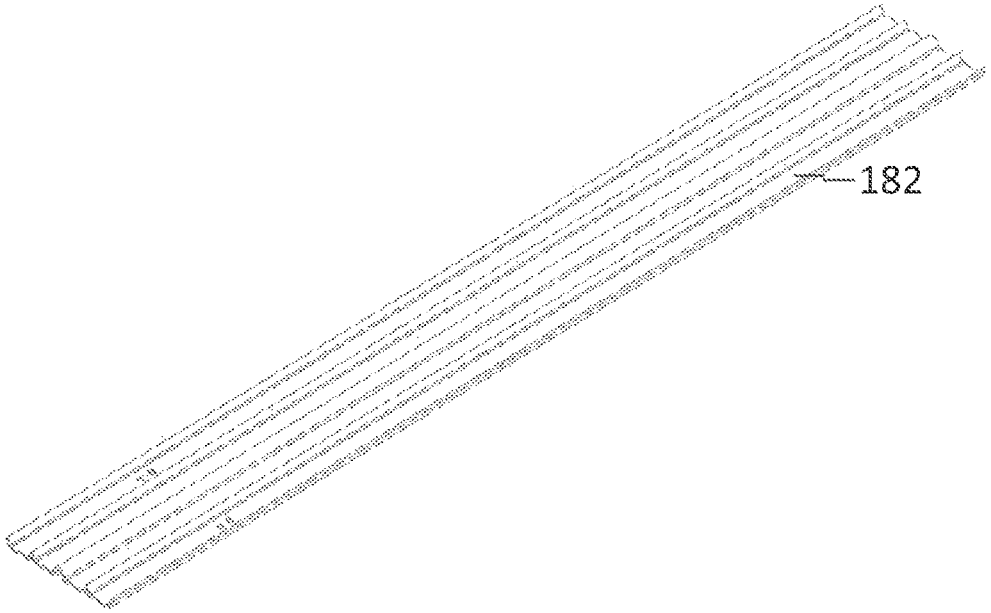
Figure 16B:
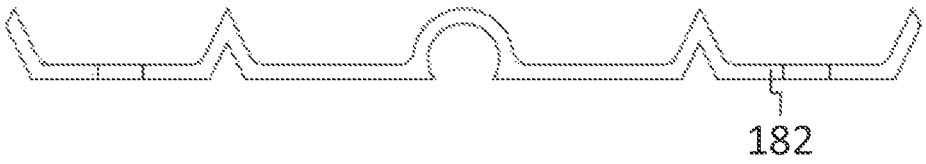

As seen in FIGS. 16A & 16B, the elongated sheet may also include elongated raised surfaces to assist in reducing friction and which also allows for easy cleaning of the exterior surface of the insert. In some embodiments, the elongated sheet extends the entire length of the product display basket 170, and in other embodiments, the elongated sheet extends less than the entire length of the display basket 170 and is placed at a particular position within the product display basket 170, for example, the front most portion. Further, in some embodiments multiple elongated sheets extending less than the entire length of the display basket 170 may be used. In some embodiments and as seen in FIGS. 14A & 14B, the friction-reducing component is U-shaped and is configured to occupy the entire inner display basket area.

As seen in FIGS. 28A-29D, a reversible product display insert 2882 may alternatively be used with the product display basket 170. The reversible product display insert 2882 includes an elongated basket insert having first and second surfaces, such as top 2884 and bottom 2886 surfaces, as well as first 2885 and second 2887 ends. In the form illustrated, a mating structure 2888 is attached to the bottom surface and allows the elongated bracket insert to mate to the product display in first and second configurations. It is understood that the reversible product display insert 2882 may include a single mating structure 2888 extending a length of the product display basket 170, or alternatively may include a plurality of mating structures 2888 spaced apart at intervals along the length of the product display basket 170. As with FIGS. 14A-16B, the product display may include a center channel which allows the insert 2882 to be friction fit or snap fit to the center runner or plurality of runners used in the product basket. Further, the insert may include notches 2889 along its side edges to allow portions of the product basket to pass by, thus minimizing overall space needed to display products. In some forms, the side notches may be configured to help align and/or position the insert, or even hold the insert in position in lieu of snap fit structures located below the insert.

In use, the reversible product display insert 2882 is inserted into the product basket in one of two configurations. In a first configuration, depicted in FIG. 28A, the first end 2885 of the product display insert 170 extends distally from the supports and includes an information display structure or mount 2890 that operates like price channel 192 discussed above. For example, price or product information indicia may be placed on display structure or mount 2890. The information display structure 2890 may comprise a channel or sleeve having an opening in which information about the product is provided, such as a placard. This information may include, for example, pricing information, information for use by the retailer, product description information, product SKU information, bar code, or the like. In some embodiments, the information display structure 2890 may be rotatable to allow information to be displayed on both sides thereof. For example, in some forms the display structure 2890 may be in the form of a tag that normally hangs down from structure 2890 (or the above mentioned channel or sleeve) with pricing or sales information relating to the product stored in the basket, and may be rotated up by a store associate to reveal a bar code or SKU number that the store associate may scan when doing inventory, stocking, etc.

Figure 28A:
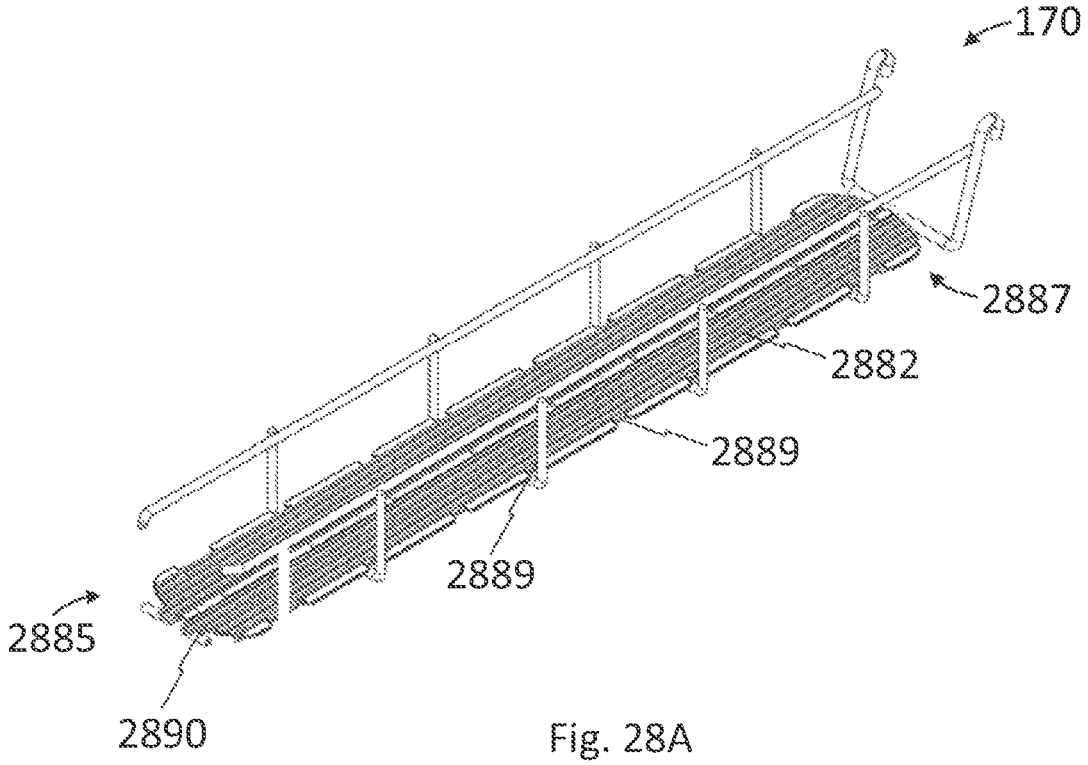
FIGS. 28A-B are right-side perspective views of an alternate basket configuration in accordance with the invention illustrating a reversible and/or removable insert for use with the wire basket display disposed on an inner surface or region of the basket to assist with dispensing of product via the basket and/or the circulation of refrigerated or conditioned air over the products in the display, with FIG. 28A illustrating a first configuration that includes a structure for displaying product information (e.g., price, sale information, bar code or sku number, etc.) at a first end of the insert, and FIG. 28B illustrating a second configuration lacking the structure at the second end of the reversible removable insert so that users can arrange or customize a display to only have the product information structure present and showing at one insert and not others, if so desired.
Figure 28B:
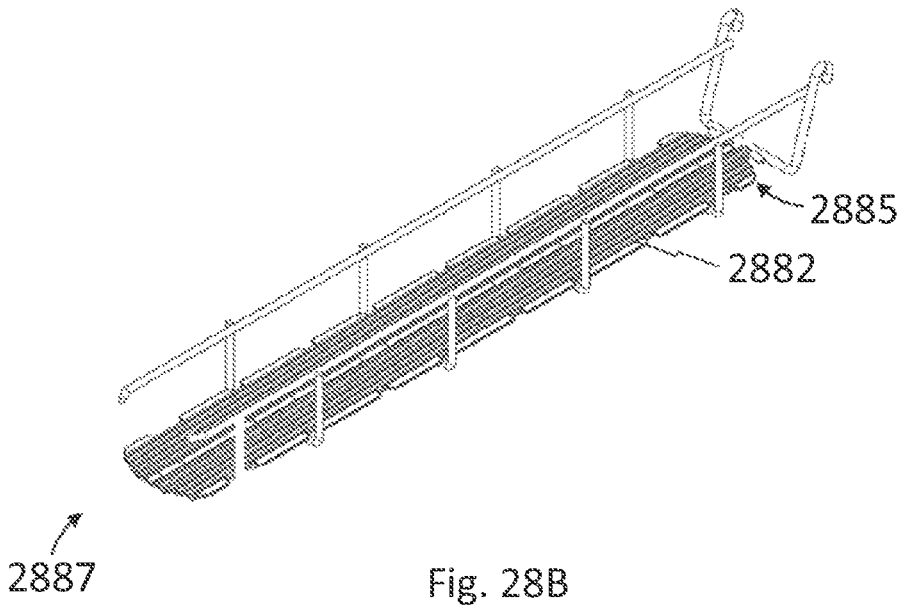
Figure 29A:
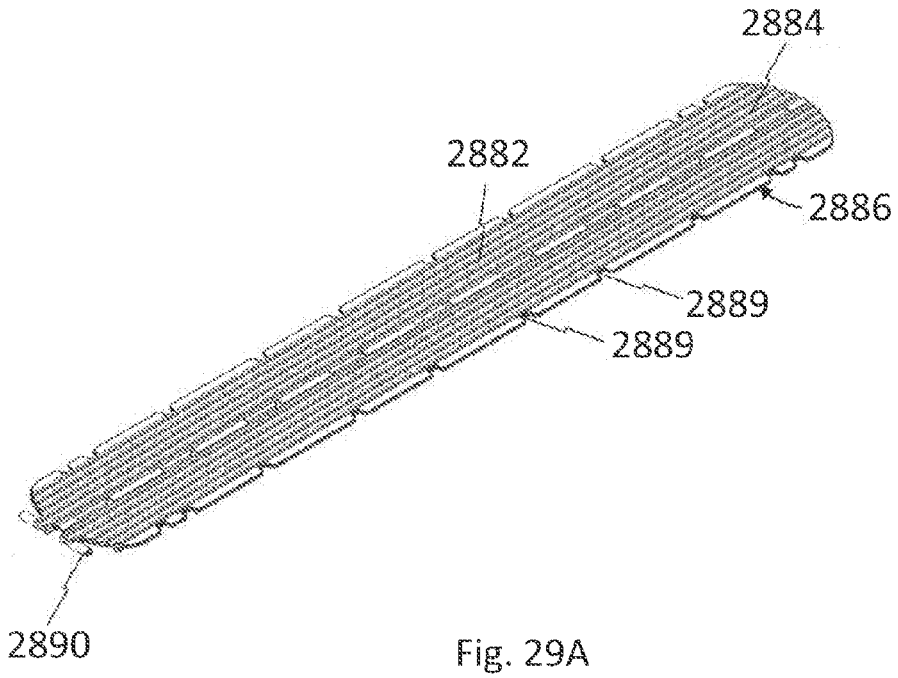
FIGS. 29A-D are perspective, front elevation, rear elevation, and bottom perspective views, respectively, of the reversible and/or removable insert of FIGS. 28A-B illustrating a friction reducing upper surface that is easy to clean and mating or securing structures for connecting the insert to any of the baskets discussed above.
Figure 29B:
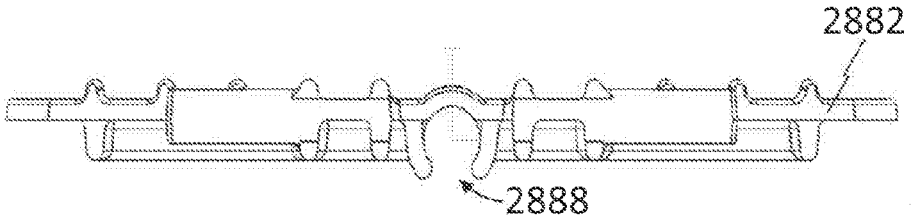
Figure 29C:
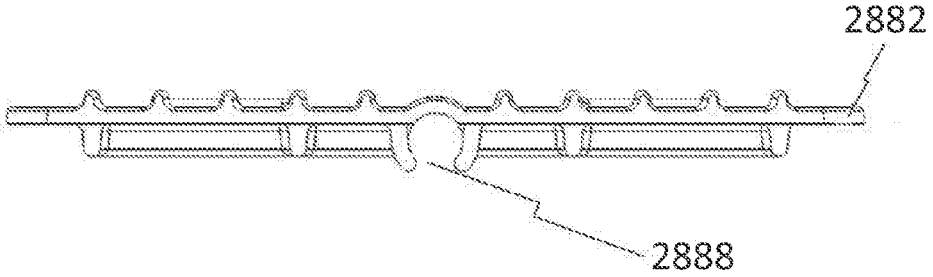
Figure 29D:
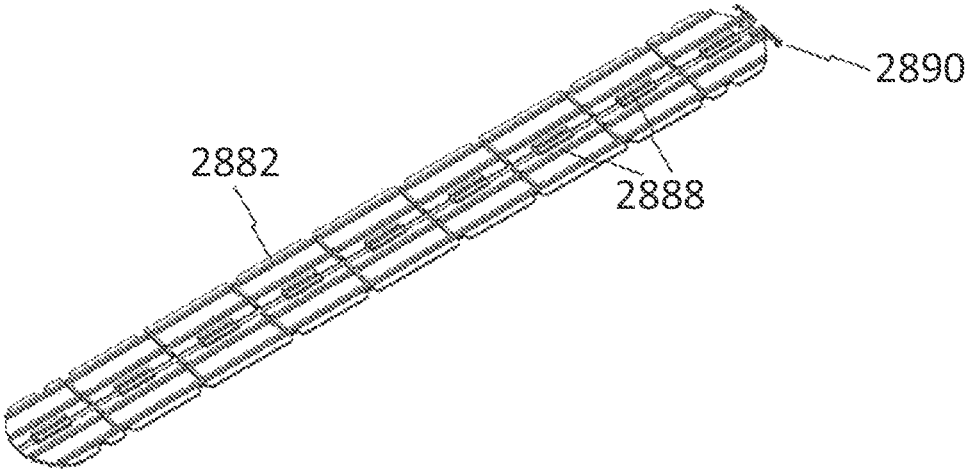

In a second configuration, depicted in FIG. 28B, the second end 2887 of the product display insert extends distally from the supports and does not include any further structure beyond an edge. As seen in FIG. 28B, the edge may be curved in order to provide an aesthetic appearance such as to track or mimic the curve of a round product displayed in the basket display. Alternatively, the edge may simply be a straight line extending between opposing sides.

So configured, the reversible product display insert allows a retailer to easily switch between insert configurations depending on whether they desire to incorporate additional product information into the display. Advantageously, the reversible product display insert provides an information display structure which may be used in displays that previously required other structures to display this information. By allowing the insert 2882 to be positioned in a second position wherein the information display structure 2890 may be hidden out of view, the product display allows store owners or displayers to keep the product display as clean as desired (e.g., without tags or indicia in front of every basket) which can be particularly helpful if a group of baskets are all selling a similar type of product at the same price. In such situations, only one insert 2882 needs to be positioned in the configuration of FIG. 28A with the product information structure 2890 visible, while the rest may remain in the configuration of FIG. 28B.

In some embodiments, it may be desirable to use a product display insert having a price channel or product display structure on both ends thereof to allow retailers to place the removable insert in either orientation while still allowing the pricing information to be viewable. Alternatively, it may be desired to have an insert without any price channel or product display structure extending from the insert. Thus, in alternate forms, insert 2882 may be designed to accommodate such desires.

As previously mentioned, the components of the product display basket 170 may be colored using conventional methods to coordinate with a particular brand or manufacturer's product or to match a retailer's desired color scheme. Doing so may result in increased visual appeal among consumers, and thus may be beneficial to consumers by allowing them to be quickly directed to a desired type of product, brand, or manufacturer. This too, may apply to the color of the insert. For example, some retailers may use a multi-color trade dress and so may design the baskets in one or more of these colors and the inserts in one or more of these colors. In other forms, the inserts may be marked with indicia (e.g. such as a word, phrase, message or design) to allow for more interaction between the retailer and its consumers and/or to provide a retailer with additional advertising space that it can use or sell.

Figure 17A:
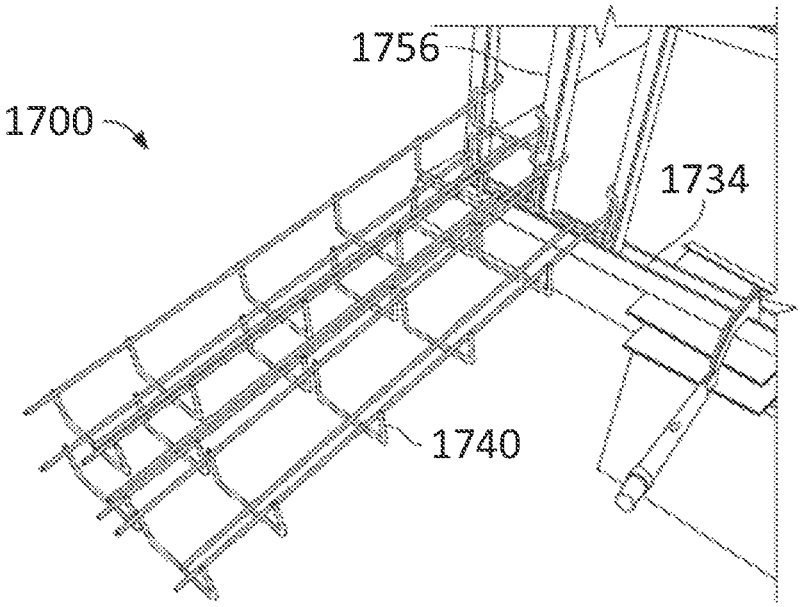
FIGS. 17A-D are perspective views of an alternate product display as configured in accordance with various embodiments of the invention, with this embodiment having basket mounting members that overlap with one another on common vertical support members to minimize horizontal gaps between the baskets and allow for basket height to be continuously adjusted (or adjusted along any portion of the vertical support member rather than incrementally adjusted over predetermined intervals like the embodiments of FIGS. 1A-B, 5A-6E and 15) to accommodate product of different size which allows the display to be customized to the products being displayed and/or setup to minimize vertical gaps, maximizing product pack out in both horizontal and vertical axes.
Figure 17B:
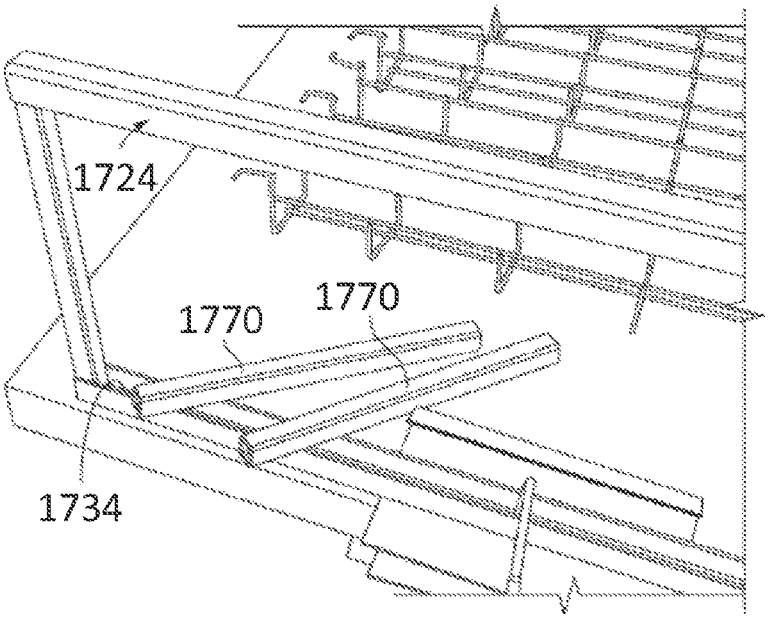
Figure 17C:
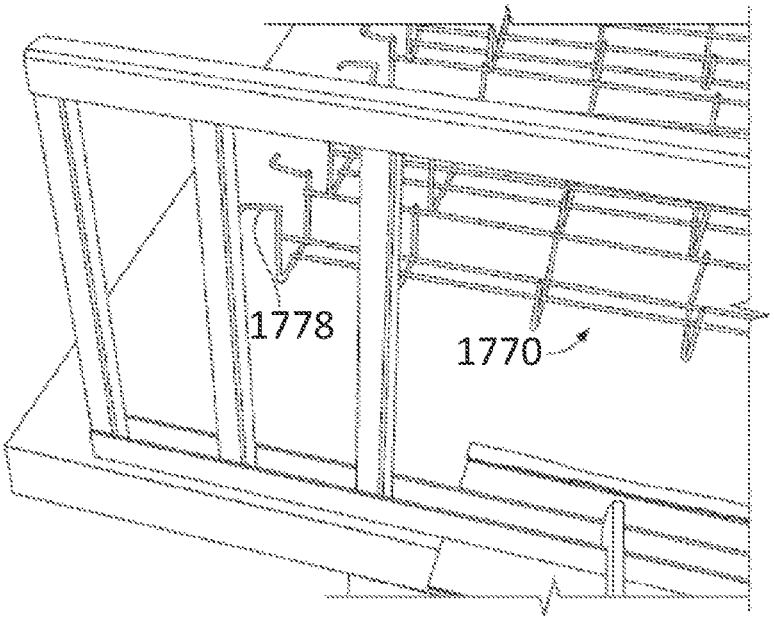
Figure 17D:
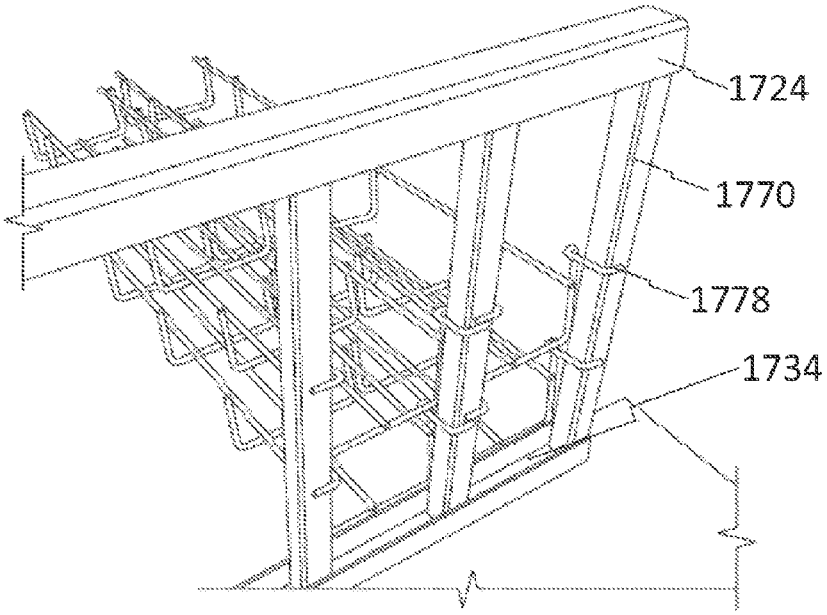
Figure 18A:
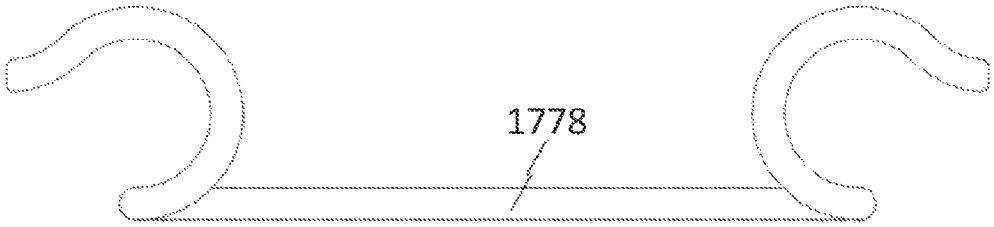
FIGS. 18A-C are top plan, front elevation and side elevation views of an exemplary rear mounting bracket for use with an overlapping basket display system like the one illustrated in FIGS. 17A-D, with FIG. 18B illustrating how the basket mounting bracket on one end is positioned at a height different than the other end so that adjacent baskets can be connected to a vertical support bar in such a way as their mounting brackets overlap to reduce horizontal spacing between the adjacent baskets and still allow the baskets to be positioned at common heights (the brackets of FIGS. 18A-C being setup for use with round vertical support bars and the brackets of FIGS. 17A-D being setup for use with rectangular (e.g., square) vertical support bars.
Figure 18B:
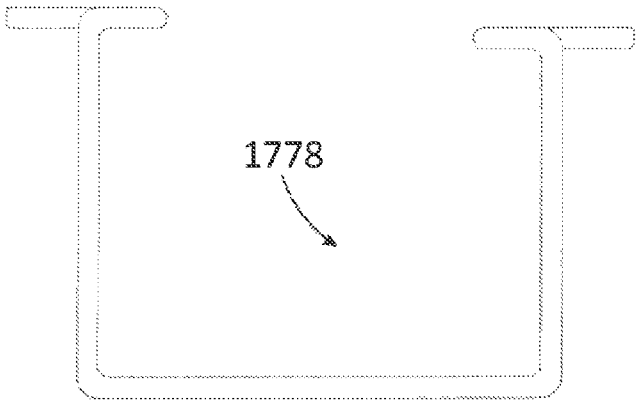
Figure 18C:
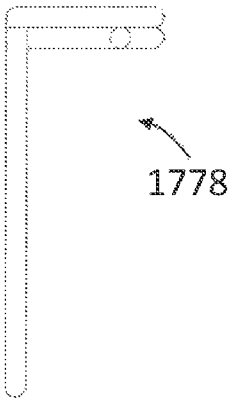

In the embodiment depicted in FIGS. 17A-18C, an alternative product display mounting configuration is shown. For purposes of convenience, items that are similar to those discussed above with respect to FIGS. 1-16 will be referenced using the same last two-digit number but using the prefix "17" simply to distinguish one embodiment form another. Thus, in FIGS. 17A-18C, the product display is referred to generally by reference numeral 1700. In this embodiment, vertical bars 1756 are mounted to a top and bottom channel 1724, 1734 by inserting the vertical bar 1756 into one of the top and bottom channel 1724, 1734 then rotating the vertical bar 1756 so that it is vertically oriented. FIGS. 18A-18C illustrate mounting portions 1778 of product display baskets 1770 which may mount to the vertical bars 1756. To mount the product display baskets 1770 to the vertical bars 1756, the product display basket 1770 is tilted or rotated in a first direction so that one side of the mounting portion 1778 engages the back and side surfaces of the vertical bar 1756. The product display basket 1770 is then tilted or rotated in a second direction (opposite of the first direction) to the horizontal position, and thus the second side of the mounting portion 1778 engages the back and side surfaces of the adjacent vertical bar 1756. The product display basket 1770 may be configured at any vertical position on the vertical bars 1756 by sliding it upwards or downwards.

As seen in FIGS. 18B & 18C, one side of the mounting portion 1778 is lower than the opposing side. This configuration allows adjacent mounting portions 1778 of adjacent product display baskets 1770 to be placed on the same vertical bar 1756. As seen in FIG. 17D, such a configuration allows adjacent product display baskets 1770 to be placed at the same height using the same vertical bar 1756, if desired. More particularly, the mounting configuration allows adjacent baskets to overlap with one another on common vertical support members 1756 to minimize horizontal gaps between the baskets and allow for basket height to be continuously adjusted or adjusted along any portion of the vertical support members 1756 rather than requiring incrementally adjusted over predetermined intervals like the embodiments of FIGS. 1A-B, 5A-6E and 15. This allows the display of FIGS. 17A-18C to accommodate product of different size and allows the display to be customized to the products being displayed on a real-time basis and/or setup to maximize both vertical and horizontal pack out of the display (e.g., the display maximizes horizontal pack out by allowing the mounting portions of the baskets to overlap one another and be suspended from common vertical support members directly adjacent one another and maximizes vertical pack out by allowing the baskets to be continuously adjusted along the vertical support members). The overlapping of the baskets also allow adjacent baskets to be positioned at common heights or positions on the vertical support members or bars and the position of the side rails or wires of the baskets are designed to space the products displayed in adjacent baskets as close as possible to one another without the product from one basket interfering with the product (or movement thereof) in the adjacent basket and vice versa.

It should be understood that the prior embodiments also allow for the display to maximize horizontal and vertical pack out, the only difference is that it is not real-time adjustable as the prior embodiments require vertical mounting brackets that are designed for specific products (e.g., having horizontal rungs that provide for incremental spacing specific for the products being displayed in order to maximize vertical pack out).

Although the baskets discussed up to now have all had an open end for dispensing product, it should be understood that in alternate embodiments baskets with a landing or receptacle for receiving the forward most facing product displayed to the consumer. For example, in an alternative embodiment, where the product display basket 170 is provided at a downward angle (e.g., gravity fed configuration), the end of product display basket 170 may include a product removal portion horizontally oriented that allows the product 102 to drop into to be removed by a consumer. Such a configuration eliminates the need for fingers, and prevents further product from sliding down the display basket 170. In a preferred form, the landing or receptacle will position the product at an angle that is most desired for presenting the displayed product to consumers (e.g., horizontally or perpendicular to the floor or shelf, tilted at a predetermined angle for intended consumers, etc.).

Figure 19A:
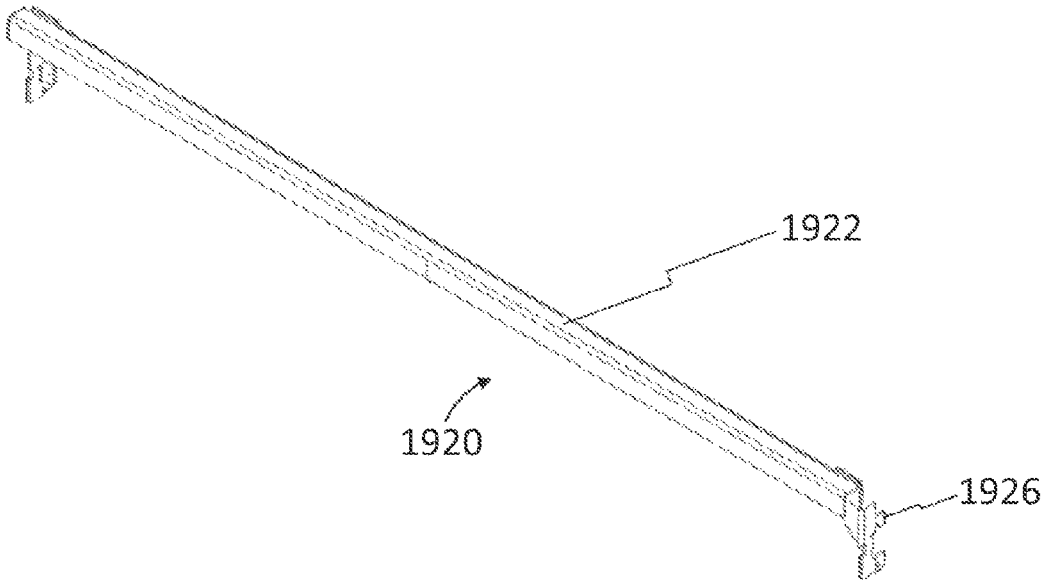
FIGS. 19A-B are front and rear perspective views, respectively, of an alternative top mounting assembly of the product display of FIGS. 1A-B as configured in accordance with various embodiments of the invention, with the channel bar of the top mounting assembly being moveable or repositionable with respect to the corresponding mounting brackets for the channel bar.
Figure 19B:
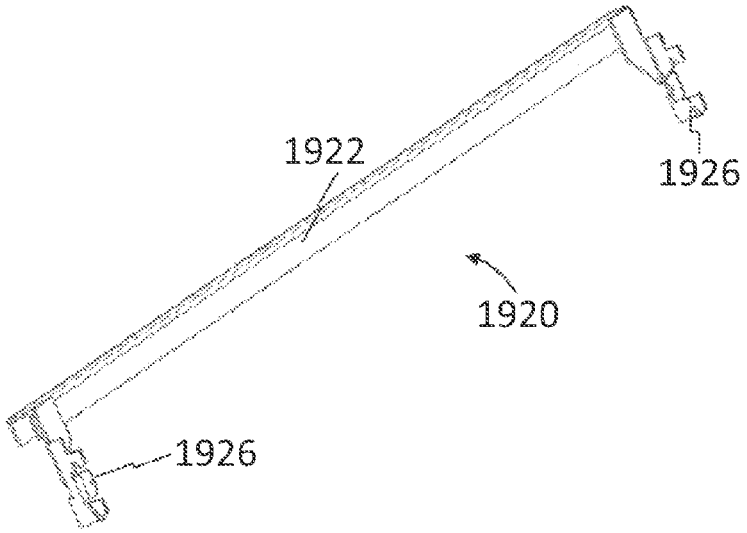
Figure 20:
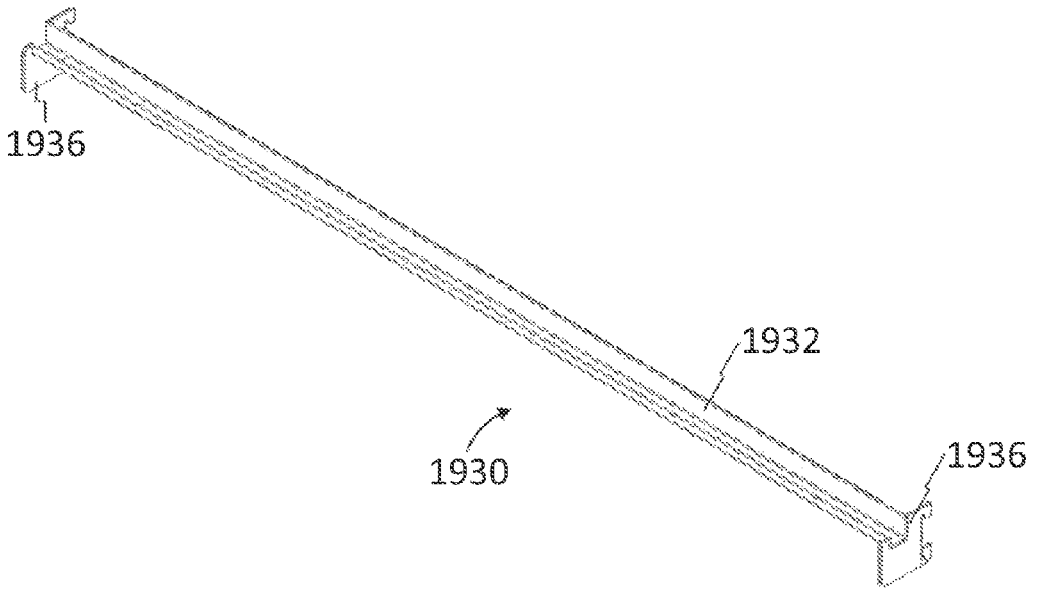
FIG. 20 is a perspective view of an alternative bottom mounting assembly of the product display of FIGS. 1A-B as configured in accordance with various embodiments of the invention, with the channel bar of the bottom mounting assembly being moveable or repositionable with respect to the corresponding mounting brackets for the channel bar.

In an alternative embodiment and as seen in FIGS. 19A, 19B & 20, alternate top and bottom mounting assemblies 1920, 1930, respectively and related methods are provided. In this embodiment, the top and bottom bars 1922, 1932, respectively are press fit into the top and bottom brackets, 1926, 1936, respectively, so that the top and bottom bars 1922, 1932 may be selectively positioned with respect to the brackets 1926, 1936 in order to accommodate different needs for different applications. For example, in some application it may be desirable to eliminate any gap between adjacent top and bottom bars so that continuous upper and lower channels are provided for the vertical support bars or back racks to be positioned in and/or moved along. An example of such a gap is illustrated in FIG. 4 above. By making the upper and lower channel bars 1926, 1936 (e.g., bars 132 in FIG. 4) repositionable or moveable with respect to their respective brackets 1926, 1936 (e.g., bracket 136 in FIG. 4), the upper and lower channels bars 1926, 1936 may be moved toward adjacent upper and lower channel bars 1926, 1936, respectively, to reduce or eliminate the gap existing between the respective upper and lower channel bars 1926, 1936 (e.g., to eliminate the gap between bars 132 in FIG. 4). In this embodiment (as with the embodiment of FIG. 4 above), vertical back racks are not constricted from lateral movement at the ends of the top and bottom bars by the top and bottom brackets, thus allowing the vertical back racks to travel seamless between adjacent top and bottom mounting assemblies. However, it should be understood that in alternate embodiments the top and bottom bars 1922, 1932 may alternatively be welded to the top and bottom brackets 1926, 1936, respectively, to provide additional security (e.g., stability) if desired.

The yogurt display provided herein utilizes an inexpensive, simple design that does not require expensive tooling to manufacture. Because a unique product display basket is designed for each product, adjustability of the vertical back racks or the product display baskets is not necessary. Because there are no moving parts, the yogurt display may be used for extended durations while incurring minimal wear and tear. The yogurt display and related methods described herein is easy to install at retail locations and requires few tools. The individual product display baskets may be designed to be secured onto the mounting bars, or may alternatively be stacked on top of each other such that each basket is supported by the one underneath it.

It is understood that the yogurt display provided herein may be configured to display a number of different products having particular container dimensions. For example, the display may be configured to hold medicine bottles, beverages, snack packages, cartons, milk, juice, chip or vegetable dips, cheese spread, supplements, butter containers, as well as other similar products. To accommodate these different products, the product display baskets 170 and vertical back racks 150 must be appropriately dimensioned.

Figure 21A:
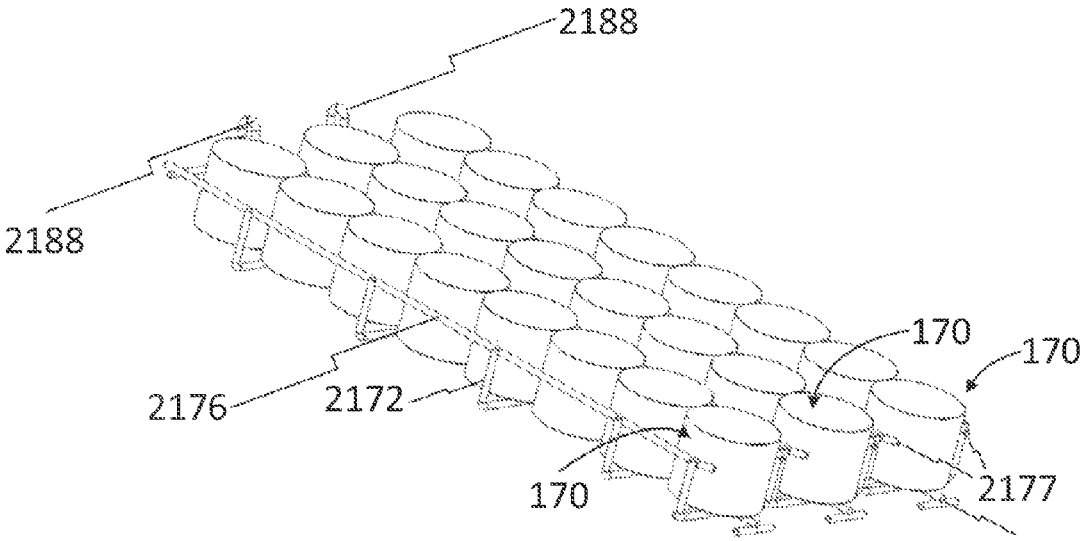
FIGS. 21A-B are perspective and right side elevation views, respectively, of an alternative multiple-column product basket as configured in accordance with various embodiments of the invention illustrating a multi-column basket unit that could be used in accordance with the invention having multiple columns of baskets supported from a common mounting or hanging member.
Figure 21B:
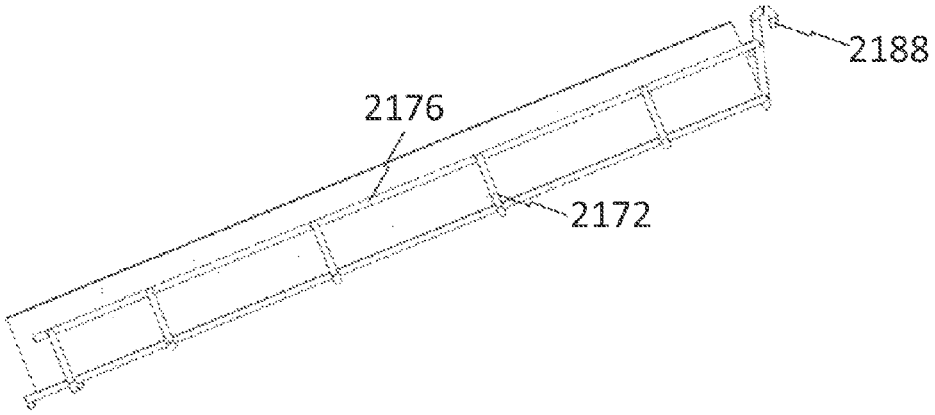

In further embodiments and as seen in FIGS. 21A-23B, a multi-basket product display unit is provided that is supported from a common mounting or hanging member. In these embodiments, a first product display basket 170 (as previously described) is mated to additional product display baskets 170 to provide for additional products to be displayed in a single integral display unit. For example, in one embodiment and as depicted in FIGS. 21A-B, product display baskets 170 are mated together in a horizontal or columnal configuration. In this embodiment, the inner side bars are mated together using conventional methods such as welding, adhesives, fasteners or the like. It is envisioned that in some embodiments, a single common side bar may be used to separate adjacent product display baskets. It is further understood that any number of baskets may be mated together, for example, two, three, four, or more, depending on retailer requirements, weight or size of product to be supported, etc. If desired, the multi-column basket unit may be configured with additional mounting or hanging members to allow for more stability, the ability to support more product or more baskets, etc.

Figure 22A:
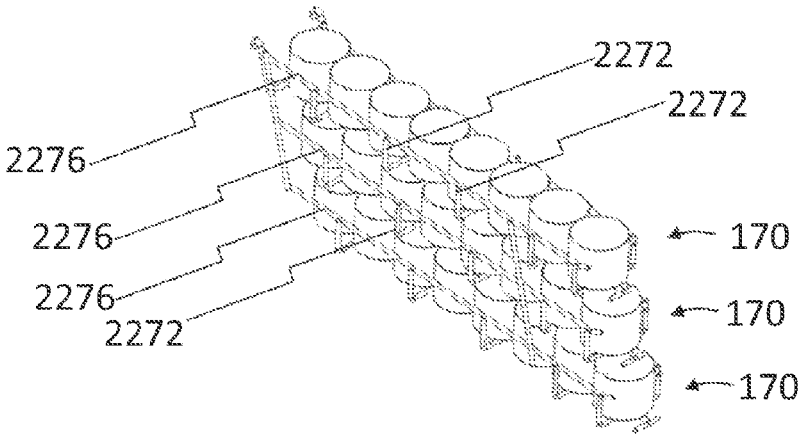
FIGS. 22A-B are perspective and right side elevation views, respectively, of an alternative multiple-row product basket as configured in accordance with various embodiments of the invention illustrating an alternate multi-row basket unit that could be used in accordance with the invention having multiple rows of baskets supported from a common mounting or hanging member.
Figure 22B:
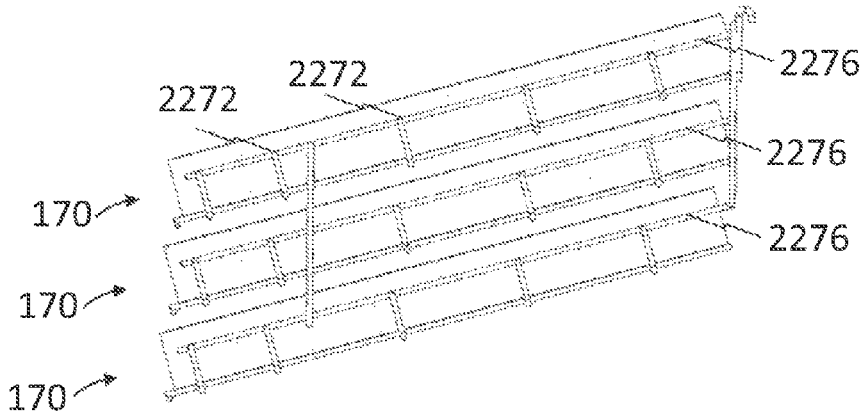

Similarly, as seen in FIGS. 22A-B, a multi-basket product display is provided where the baskets are configured in a vertical or rowed orientation. In this configuration, the side bars of the individual display baskets may be mounted to a common vertical U-bar or alternatively to a support appropriately dimensioned. It is understood that in some embodiments, additional mounting mechanisms may be used if desired. For example, if it is desired to have a multi-row basket unit supported at multiple points, additional rear mounting brackets or hooks may be provided, however, these mounting or hanging brackets remain common to the unit as a whole. It is further understood that any number of baskets may be mated together, for example, two, three, four, or more, depending on retailer requirements. Again, the exact number of baskets may be limited by a particular application (e.g., size of display case that baskets will be mounted in, weight or size of product being displayed, etc.).

Figure 23A:
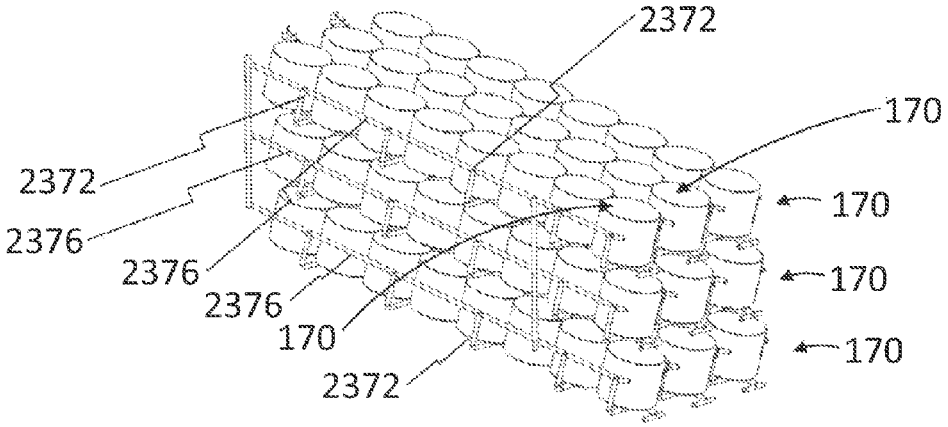
FIGS. 23A-B are perspective and right side elevation views, respectively, of an alternative multiple-row and column product basket as configured in accordance with various embodiments of the invention illustrating yet another multi-row and column basket unit that could be used in accordance with the invention having multiple rows and columns of baskets supported from a common mounting or hanging member.
Figure 23B:
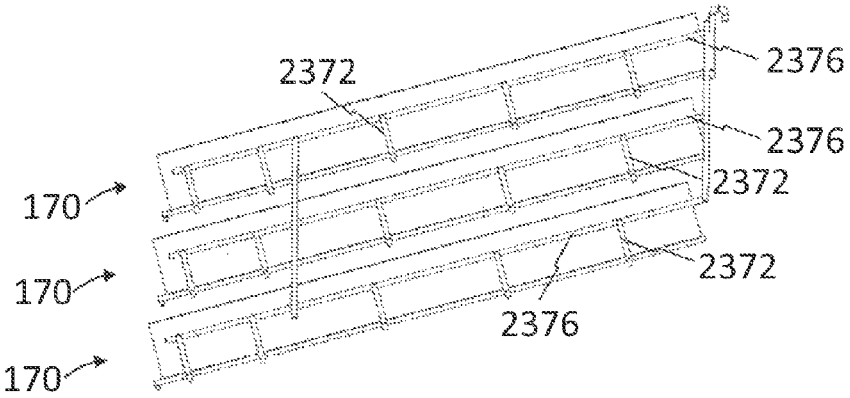

Further still, as seen in FIGS. 23A-B, a multi-basket product display is provided where individual baskets are mated together in a multi-row, multi-column (or matrix) configuration having both rows and columns. It is understood that in these embodiments, the individual product display baskets 170 may be mated to one another in any of the above referenced methods as well as any other commonly used methods of affixation. It is further understood that any number of baskets may be mated together to form this matrix. For example, even matrices such as a 2×2 matrix (e.g., two rows by two columns), 3×3, 4×4, or any other dimension may be used depending on retailer requirements, as could odd matrices such as a 2×3 matrix (e.g., two rows by three columns), 2×5, 3×4, 3×5, 3×2, or any other dimensioned matrix.

By incorporating multi-basket units into the product display, it is possible to quickly allow for an entire case of product to be merchandised. For example, by incorporating multi-basket displays into a retail environment, retailers may be able to simply open a single case of product containing 12, 16, 18, 24, or any other appropriate conventional number of products and fully merchandise the multi-basket display without having to provide additional displays.

Figure 24:
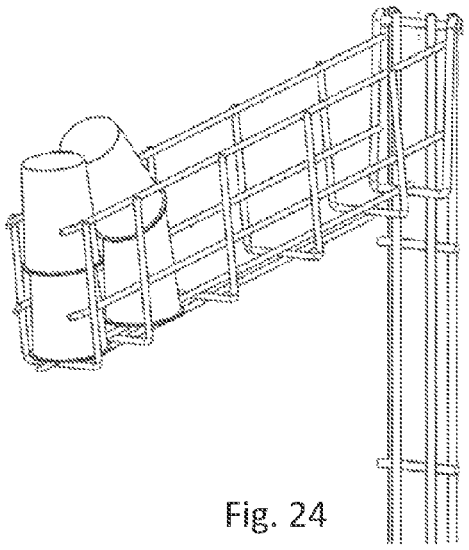
FIG. 24 is a perspective view of a basket type product display for displaying and/or dispensing multiple rows of product or stacked product in a single basket in accordance with aspects of the invention.
Figure 25A:
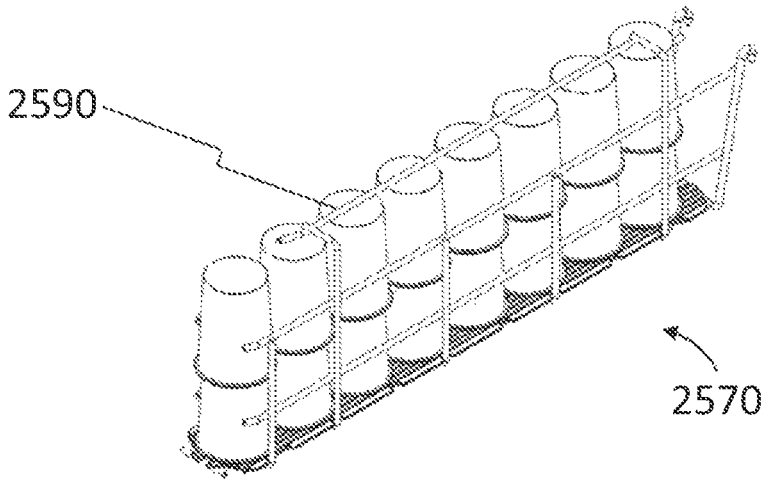
FIG. 25A-B are left-side perspective and right side perspective views of an alternate basket configuration in accordance with the invention illustrating an alignment or guide structure, such as an anti-toppling member, for use with the basket display to maintain alignment of product as the product moves or slides from one end of the basket to the other end of the basket (e.g., as it is auto-faced or merchandised from the rear of the basket toward the front of the basket)
Figure 25B:
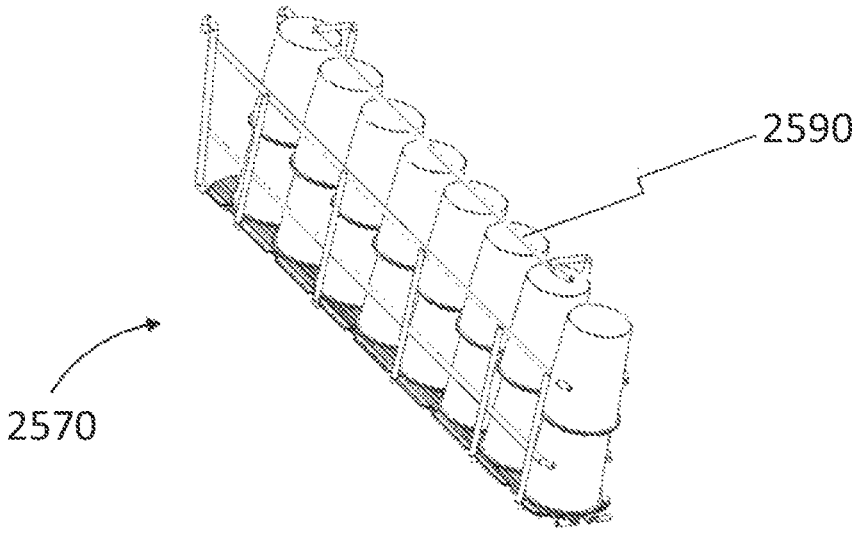
Figure 26:
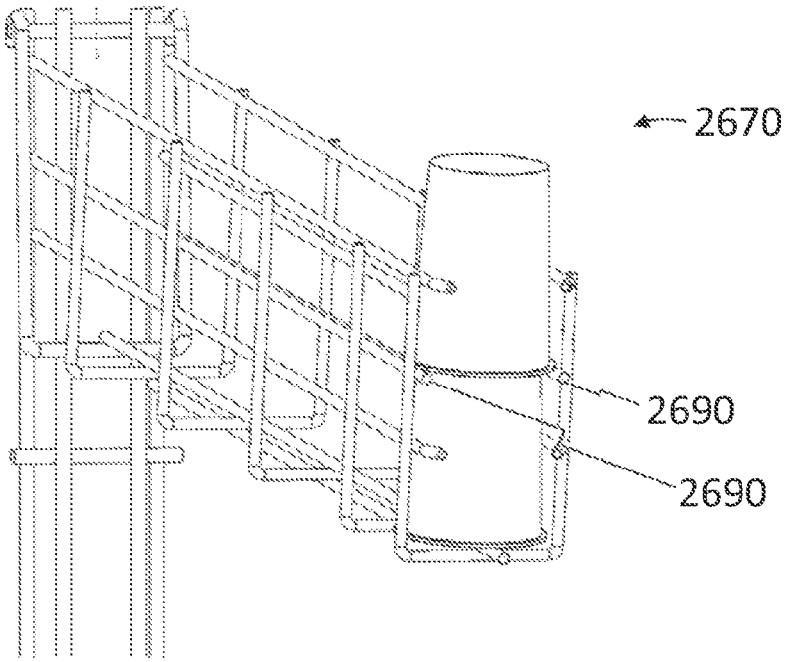
FIG. 26 is a front perspective view of an alternate basket configuration in accordance with the invention illustrating an alternate alignment or guide structure, such as an anti-toppling member, for maintaining the alignment of the product and/or preventing toppling of same as it is moved from one end of the basket to the other (e.g., as it is auto-faced or merchandised)

In other embodiments, and as seen in FIGS. 24-26, an alternate stabilizing or alignment/guide device is provided to help assist in the maintaining of product alignment through its travel within the basket 2570 and/or to reduce or eliminate the possibility of a product tipping over (as seen in FIG. 24) or one basket interfering with the operation of another basket or the merchandising of the product therein (e.g., auto-facing or movement of product from the rear of the display to the front of the display). In this embodiment, an upper guide member or runner 2590 is positioned at a height above the top surface of the product to create an additional constraint and/or guide. As shown in FIG. 25A, the upper runner or alignment mechanism 2590 may be coupled to or integrally formed by one of the U-bars or side rails. For example, one vertical portion of each U-shaped brace may extend up vertically next to and above the display product packaging and may bend in horizontally over the top of the display product packaging. The upper runner is then connected to the horizontal portions that extend above the product packaging and runs a length of the basket to maintain product alignment and prevent tipping/tippage (or misalignment) of the product as it moves within the basket. In some embodiments, the distal end of the upper runner may be bent upwards to provide for additional clearance when merchandising (either original merchandising or re-merchandising of product) or removing the product from the display basket. In the form illustrated, the inverted L-shaped arm that the upper runner connects to, is connected to one end of the U-shaped brace via welding, adhesives, fasteners, etc. In alternate forms and as mentioned above, the inverted L-shaped member could be formed integral with the U-shaped braces and/or may be made out of a variety of different shapes and sizes (e.g., could be a flattened plate type structure instead of a round wire, could be constructed of a plurality of guide members rather than one continuous or elongated guide member, etc.).

Figure 27:
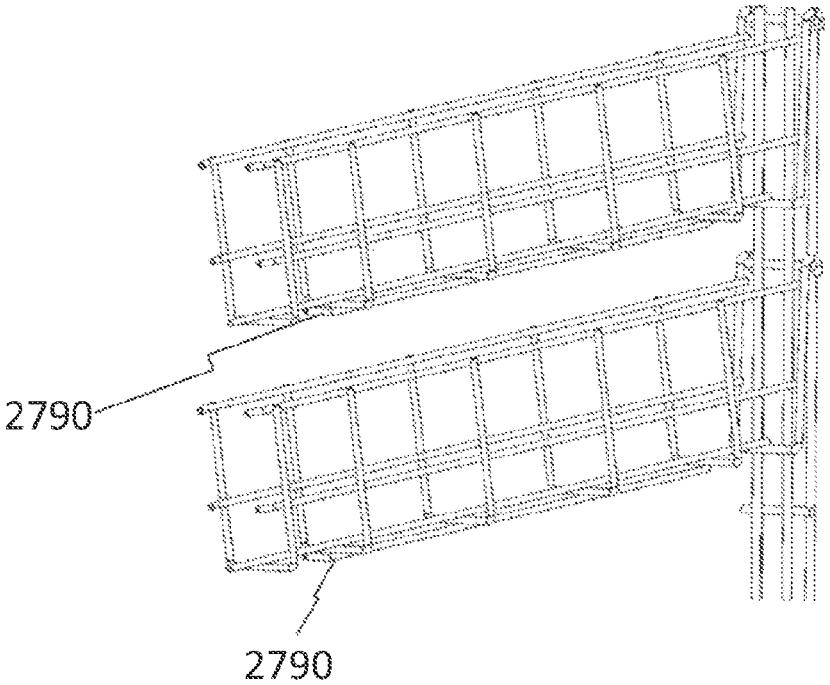
FIG. 27 is a perspective view of an alternate basket configuration in accordance with the invention illustrating an alternate alignment or guide structure, such as an anti-toppling member, installed on a bottom surface of the product display basket for use in aligning or guiding product positioned below the product display basket (e.g., such as product displayed in a basket below the illustrated basket)

In still further embodiments, and as seen in FIG. 27, the upper runner 2790 or guide structure may be coupled to the bottom side of an adjacent product display basket. For example, the upper runner may be mated to the underside of one of or a plurality of U-bars or directly to the lower runner. Preferably, this will be mounted to the lower surface of the U-bars so that the alignment runner parallels the center channel runner of the basket. With this configuration, the guide structure 2790 maintains the alignment of products positioned below the basket, such as for example, products in a basket positioned below the basket with the guide structure. In a preferred form, the configuration of FIG. 27 is used for all lower rows of baskets and the configuration of FIGS. 25A-B is used for the top row of baskets.

In further embodiments, and as seen in FIG. 26, additional product support configurations are provided in the form of additional runners 2690. In these embodiments, when product is stacked on top of one another, side runners 2690 may be used to provide a support for the bottom surface of the product stacked on top of or above the lower row of product. In these embodiments, the side runners act as rails to stabilize at least the upper product during movement towards the distal end of the display basket. In some embodiments, opposing sides of the product display basket 2670 each have a side runner 2690 coupled thereto. In other embodiments, only one side of the product display basket has a side runner 2690 coupled thereto. The side members or runners 2690 may be mated to the product display baskets in any of the methods mentioned herein as well as any well-known securing means. In the form illustrated, the side rails or runners 2690 still allow the upper and lower products to overlap one another to conserve vertical spacing, but simply help guide movement of the upper product packaging so that it does not tip throughout its movement in the basket. This may be configured such that the upper packaging rests on the lower packaging or alternatively configured so that the upper packaging is spaced from the lower packaging by a minimal amount such as not to affect the display's ability to maximize vertical pack-out.

In the embodiments discussed above, it should be understood that wire has been chosen to form the baskets for the display. Wire is easy to manufacture, bend or shape into a desired design and connect together. Thus, baskets that are specific to the product they are intended to display can be readily manufactured and used in the marketplace. In addition, if any manufacturers change their product packaging or if new packaging comes out on the market (regardless of whether from a known manufacturer/supplier or a new manufacturer/supplier), new baskets can readily be made specific to the changed packaging or new packaging so that the display can be used to not only display such items, but do so in a manner that allows the vertical and/or horizontal pack out of the changed or new packaging to be improved, if not maximized. Wire also provides a very light structure that is easy to lift, making the display easier to setup. In addition, wire adds minimal weight to the product display so that lighter materials can be used in the display and the display causes less wear and tear on any additional surround portions of the display, such as surrounding coolers, shelving, etc. In the embodiments illustrated above, round wire having a diameter of one hundred eighty-seven thousandths of an inch (0.187") is utilized to configure the baskets and the following spacing or positioning of the floor (whether that is from the center runner or from any insert disposed therein) and side members is utilized for the most common brands of yogurt:

| Yogurt Cup Type | Floor to Center of Side Wires | Spacing Between Side Wires |
|---|---|---|
| Brand A | 1.56 and 4.50 (due to this product being double stacked) | 2.32 |
| Brand B | 1.33 | 3.11 |
| Brand C | 1.31 | 2.59 |
| Brand D | 1.85 | 2.79 |

Figure 8B:
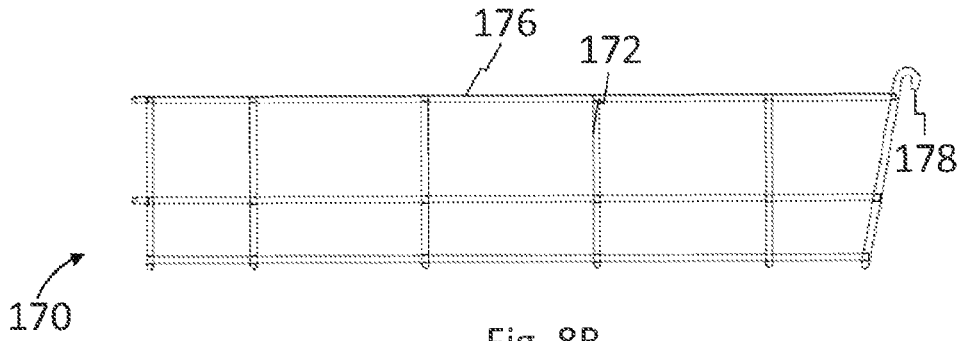
Figure 8C:
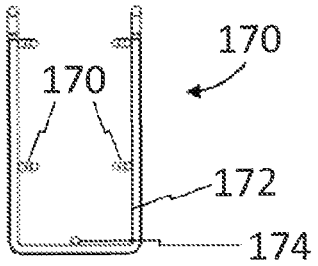

Thus, for Brand A, a basket is configured to hold double stacked (e.g., product stacked one on top of another) like that shown in FIGS. 8A-C with the first or lower set of side alignment wires (176) positioned up from the upper surface of the product floor of the basket (whether that be from an upper surface of a center runner (174) or an upper surface of an insert (e.g., 182, 2887, etc.)) one and fifty-six hundredths of an inch (1.56") (measured from the floor to the center of the side alignment wires) and spaced apart by two and thirty-two hundredths of an inch (2.32") to properly position the lower row of Brand A product in the basket. The second or upper set of side alignment wires (176) being positioned up from the upper surface of the displayed product floor of the basket four and fifty hundredths of an inch (4.50") and similarly spaced apart by two and thirty-two hundredths of an inch (2.32"). In a preferred form, this basket is used with a vertical support similar to that shown in FIG. 6B.

Figure 9A:
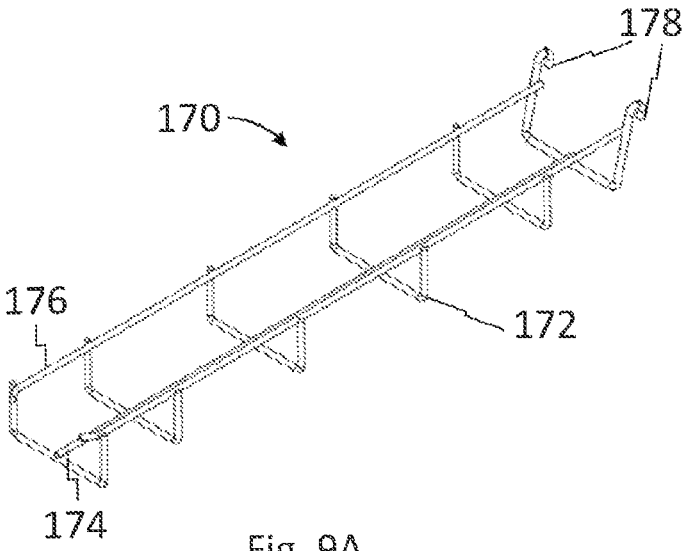
FIGS. 9A-C are perspective, right side elevation, and front elevation views, respectively, of a product basket of the product display of FIGS. 1A-B as configured in accordance with various embodiments of the invention with the basket being configured to display a second brand of product with a second size and shape different than the first brand's size and shape.
Figure 9B:
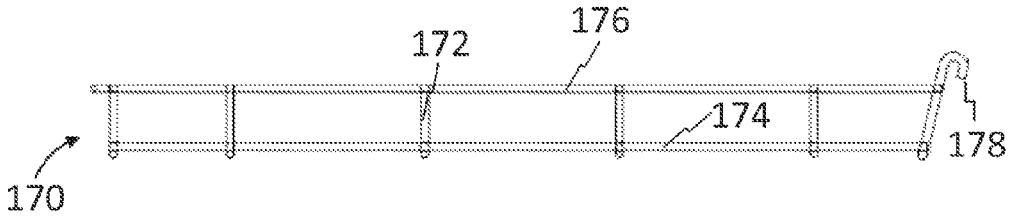
Figure 9C:
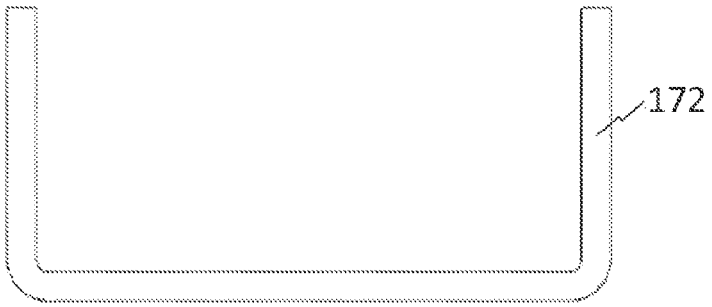

For Brand B, a basket is configured to hold a different type and/or shape/size product than Brand A like that shown in FIGS. 9A-C with the side alignment wires (176) positioned up from the upper surface of the floor of the basket one and thirty-three hundredths of an inch (1.33") (measured from the upper surface of the floor to the center of the side alignment wires) and spaced apart by three and eleven hundredths of an inch (3.11") to properly position the product of Brand B in the basket so that it can be gravity fed through the basket with ease and without interfering with neighboring product or product baskets. Again, the upper surface of the floor being the upper surface that the displayed product rests on (e.g., upper surface of a center or multi-wire runner, upper surface of an insert, etc.). In a preferred form, this basket is used with a vertical support similar to that shown in FIG. 6C.

Figure 11A:
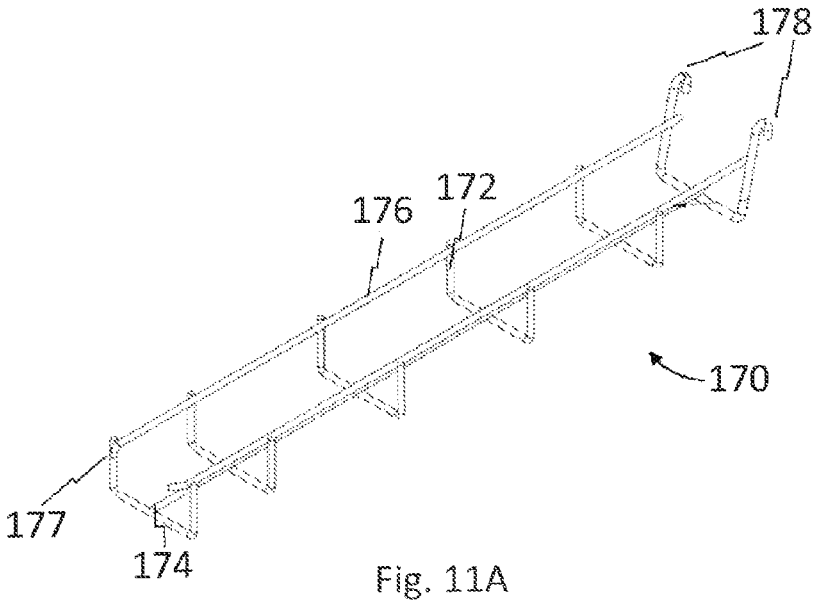
FIGS. 11A-C are perspective, right side elevation, and front elevation views, respectively, of a product basket of the product display of FIGS. 1A-B as configured in accordance with various embodiments of the invention with the basket being configured to display a fourth brand of product with a fourth size and shape different than the sizes and shapes of the first, second and third brands.
Figure 11B:
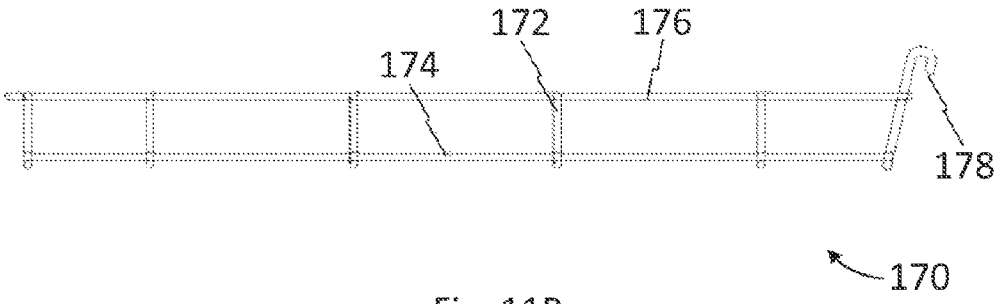
Figure 11C:
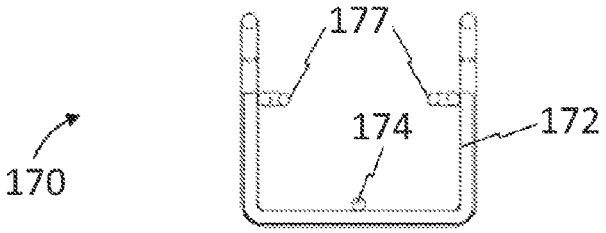

Similarly, for Brand C, a basket is configured to hold product different than Brands A or B (e.g., whether in type, shape, size, etc.) like that shown in FIGS. 11A-C with the side alignment wires (176) positioned up from the upper surface of the floor one and thirty-one hundredths of an inch (1.31") and spaced apart by two and fifty-nine hundredths of an inch (2.59") to properly position the product of Brand C in the basket so that it can be gravity fed through the basket with ease and without interfering with neighboring product or product baskets. In a preferred form, this basket is used with a vertical support similar to that shown in FIG. 6D.

Figure 10A:
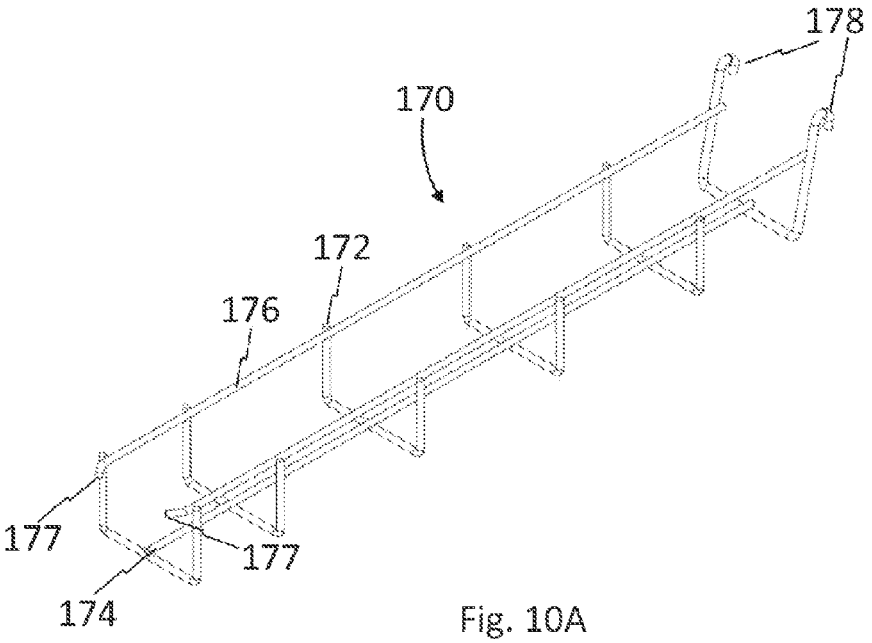
FIGS. 10A-C are perspective, right side elevation, and front elevation views, respectively, of a product basket of the product display of FIGS. 1A-B as configured in accordance with various embodiments of the invention with the basket being configured to display a third brand of product with a third size and shape different than the sizes and shapes of the first and second brands.
Figure 10B:
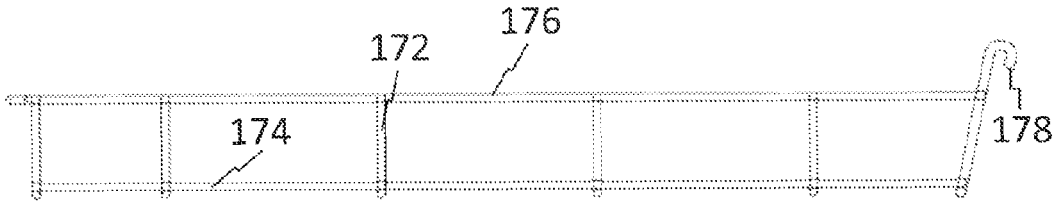
Figure 10C:
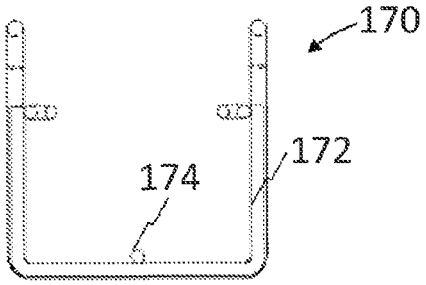

Likewise, for Brand D, a basket is configured to hold product different than Brands A-C (e.g., whether in type, shape, size, etc.) like that shown in FIGS. 10A-C with the side alignment wires (176) positioned up from the upper surface of the floor one and eighty-five hundredths of an inch (1.85") and spaced apart by two and seventy-nine hundredths of an inch (2.79") to properly position the product of Brand D in the basket so that it can be gravity fed through the basket with ease and without interfering with neighboring product or product baskets. In the embodiment depicted, Brand D actually is a generic basket intended for use with common six ounce (6 oz.) yogurt cups, whereas the baskets of Brand A-C are intended for use with specific brands of yogurt. In a preferred form, this basket is used with a vertical support similar to that shown in FIG. 6E.

Based on the above embodiments, it should be understood that a product display is disclosed herein that is configured to improve product pack out in a display. In one form, the display includes a plurality of individual vertical supports and a plurality of product dispensers connected to the supports to form support and dispenser sets, at least one of the vertical supports and product dispensers being sized or dimensioned based on a specific product to be displayed in the product dispenser to improve product pack out in the display. The vertical supports may have first mating structures and the plurality of product dispensers may have second mating structures that mate with the first mating structures to suspend the product dispensers from the vertical supports, at least one of the mating structures being positioned to reduce spatial gaping between the product dispensers of a support and dispenser set to improve vertical product pack out with respect to that support and dispenser set. At least one of the mating structures may be configured to suspend the product dispensers in the support and dispenser set at a predetermined angle that biases the specific product to be displayed in the product dispensers toward a front of each of the product dispensers to automatically front face the specific product to be displayed in the product dispensers. The predetermined angle may be selected for the specific product to be displayed in the product dispenser so that the predetermined angle is sufficient for purposes of front facing the specific product to be displayed in the product dispenser but small enough of an angle to improve the number of product dispensers that can be connected to the vertical support to improve vertical product pack out with respect to the support and dispenser set and display. For example, if a product may be sufficiently gravity fed at an angle between six to eight degrees) (6°-8°, then the six degree angle will preferably be selected because it will potentially allow for more rows of shelving to be installed in the display and because it will make it easier to remove product from lower shelving rows because they are not positioned at a steeper angle.

As has been mentioned multiple times above, each support and dispenser set will preferably be sized or dimensioned for the specific product that is to be displayed in the product dispensers so that each support and dispenser set provides sufficient room for the front facing of the specific product to be displayed in the dispensers of each support and dispenser set but efficiently enough (e.g., narrow enough, small enough, etc.) to improve the number of support and dispenser sets that can fit within the display to improve horizontal product pack out with respect to the display. The product dispensers will also preferably be moveable or repositionable with respect to one another, or in some cases where multiple dispensers are interconnected to form a multi-dispenser unit (e.g., multi-row, multi-column, or multi-row and multi-column units), the units will remain moveable or repositionable with respect to one another even if the individual dispensers are not moveable with respect to one another.

In a preferred form, the product display will include at least one mounting channel that defines an unobstructed passage within which the vertical supports of the support and dispenser sets may be disposed, the mounting channel being open ended to allow at least one vertical support to extend laterally beyond an end of the mounting channel to improve horizontal product pack out of the display by removing obstructions from the passage defined by the mounting channel that would otherwise limit the number of supports that can be disposed in the mounting channel and display. In some embodiments, the at least one mounting channel comprises at least two mounting channels positioned proximate one another and open ended to allow at least one vertical support to be disposed in the passageway defined by the mounting channels positioned proximate to one another traversing any gap that may exist therebetween (or between the two mounting channels aligned proximate with one another).

In a preferred form, the vertical supports and product dispensers are made of round or tubular wire and the product dispensers comprise baskets with each basket configured to the specific product to be displayed therein and formed from a plurality wires used to define a bottom and opposing sides of the basket, the plurality of wires forming a generally U-shaped channel with an open front through which the specific product displayed therein may be removed, each basket also containing a product retention member for hindering unintentional removal of the specific product displayed within the basket and an insert positioned at the bottom of the basket for assisting in the front facing and dispensing of the specific product displayed in the basket and/or directing airflow along the specific products displayed in the baskets of the display.

It should be appreciated that in the embodiments discussed herein, wire portions of varying sizes, shapes and dimensions may be used to achieve the product display baskets described, thus the specific design of the display baskets and brackets illustrated is ornamental in nature. For example, wire having a circular, rectangular, flat, triangular, or any other conceivable cross section may be used to construct the product display baskets. In addition, in some embodiments, the wire may be replaced with strips of material, sheets or material or even molded or cast parts. It should also be understood, that the inventions disclosed herein include the basket or bracket alone, the basket and bracket in combination with one another, the basket and bracket in combination with the surrounding display structure, such as without limitation the refrigeration or freezer unit (e.g., cooler), and methods relating to each of these structures or combination of structures. Further, although specific examples are given illustrating use of the basket and bracket sets for displaying yogurt and even specific types of yogurt, it should be understood that the displays in accordance with the inventions disclosed herein may be used to display any type of product capable of being displayed in such manner (e.g., not just yogurt, not just product with deformable packaging, etc.).

Similarly, although baskets are illustrated in the above embodiments, it should be understood that the inventions disclosed herein may be provided in alternate configurations using any form of product receptacle (e.g., sleeve, channel, dispenser, shelving, etc.) and support bracket so long at one or more of the product receptacle and support bracket are configured for use with a specific type of product (e.g., sized or dimensioned for a specific shaped product, specific size product, a specific brand of product, etc.). In a preferred form, both the vertical supports and product receptacles will be configured for specific products (e.g., specific brands, specific manufacturers of products, specific types, all or any one of these, etc.), however, in some forms a vertical support may be configured for one or more first product receptacles configured for a first specific product and one or more second product receptacles configured for a second specific product.

In addition to the previously discussed embodiments, a method for displaying products is herein described. The method includes mounting a plurality of vertical brackets to a product display cooler and mounting a plurality of product display baskets to the plurality of vertical brackets. The method may further entail placing a plurality of products in the plurality of product display baskets, if so desired. As stated previously, the product display baskets have side walls configured to display the product such that movement of the product from the rear end of the product display basket to the front end of the product display basket is not interfered with by adjacent product display baskets or products disposed in the adjacent product display baskets.

In some embodiments, a method of manufacturing a product display comprises fabricating a vertical bracket having at least one mounting arm coupled thereto and fabricating a product display basket having at least one mounting region configured to mate the product display basket to the vertical bracket. The product display basket being fabricated to contain a particular type of product to ensure movement of the product from a rear end of the product display basket to a front end of the product display basket is not interfered with by items contained outside of the product display basket, for example, adjacent product display baskets or products contained within adjacent product display baskets. As previously mentioned, because the product display baskets are so configured to minimize vertical and horizontal clearances between adjacent product display baskets and their corresponding products, movement within a single product display basket is not interfered with.

In other embodiments, a method of providing a multi-columned product basket is provided. The method of providing a multi-columned basket includes positioning a first wire basket unit adjacent to a second wire basket unit and forming an integral multi-basket display. In some embodiments, the first and second wire basket units are configured horizontally to display a product in rows, and in other embodiments, the first and second wire basket units are configured vertically to display a product in columns. In other embodiments, additional wire basket units are positioned to form an integral multi-basket display configured to arrange the product in a matrix.

In some embodiments, the method further includes suspending the wire basket units from a vertical bracket at a downward angle. These embodiments allow for a product to be automatically front-faced due to gravitational forces. In other embodiments, the method further includes coupling an upper runner to the multi-basket display to stabilize the product from tipping over as described above.

Another method in accordance with the invention includes a method of manufacturing a product display by configuring at least one of the vertical support and product receptacle or dispenser (e.g., basket, shelving, sleeve, channel, etc.) for a specific product to be displayed in order to improve horizontal or vertical pack out of that specific product within the display. In one form, the method comprises sizing or dimensioning a first vertical support and plurality of first product receptacles for a first brand of product to reduce spatial gaping between at least two of the first product receptacles when mounted to the first vertical support, and sizing or dimensioning a second vertical support and plurality of second product receptacles for a second brand of product to reduce spatial gaping between at least two of the second product receptacles mounted to the second vertical support and/or to reduce spatial gaping between the first and second vertical supports and/or product receptacles mounted to each respective vertical support. It should be understood that in some forms a vertical support may be capable of being configured (e.g., sized or dimension) for more than one specific product or specific brand of product and, thus, in some forms the invention includes configuring a vertical support for at least one specific product and configuring each product receptacle that is to be connected or mounted to the vertical support for a specific product (e.g., a specific brand of product) to reduce, if not minimize, spatial gaping between each product receptacle on the vertical support. In this way, the vertical support is configured for the specific product receptacles or dispensers Thus, in summary, various embodiments are contemplated in accordance with the invention disclosed herein. For example, in one form, a basket product display is provided that includes a vertical support and a product basket (e.g., FIG. 1A). The product basket is configured to mount to the vertical support and display product in a front-facing manner in which product from a rear of the product basket is automatically biased toward a front of the product basket. The vertical support and/or the product basket are configured to display a particular product (for example, a particular brand or manufacturer's product) in order to maximize pack out in at least one of a vertical and a horizontal direction within the product display.

In one form, the vertical support comprises a plurality of individual vertical supports. Further, the product basket comprises a plurality of baskets mounted to each vertical support to form a vertical support and basket set configured to maximize pack out in the horizontal direction within the display by spacing each support and basket set horizontally to provide adequate clearance for each support and basket set and minimizing gaps that occur between each support and basket set.

The product basket may comprise a plurality of baskets mounted to the vertical support and is also configured to maximize pack out in the vertical direction within the product display (e.g., FIG. 5C). The baskets are spaced vertically on the vertical support to provide adequate clearance for the particular product displayed in each basket. Further, gaps that occur between the baskets mounted to the vertical support are minimized.

In one form, the vertical support comprises a plurality of individual vertical supports and the plurality of baskets comprises a plurality of baskets mounted to each vertical support to form a vertical support and basket set. The plurality of vertical supports and plurality of baskets are configured to maximize pack out in both the vertical and horizontal directions within the product display by having each vertical support and basket set configured to display a particular product to provide adequate clearance horizontally between each vertical support and basket set and vertically between each basket mounted to each individual vertical support and minimize gaps between each vertical support and basket set and each basket mounted to each individual vertical support (e.g., FIGS. 1B & 5C). In one form, the individual vertical supports of each support and basket set have a support width that is equal to or greater than any basket width of the baskets from the support and basket set so that the vertical supports ensure proper spacing is provided for each basket in the support and basket set.

In one form, the vertical support comprises at least one post to which the product basket is mounted via a mounting member (e.g., a hook or other mounting mechanism). Further, the basket is a wire basket having a bottom surface, opposing side surfaces and an open front through which product is moved, where the bottom surface and opposing side surfaces together define an internal channel within the basket (e.g., FIG. 7). The post comprises a vertical bracket having at least two upstanding bars or mounting bars and a plurality of rungs positioned transverse to the at least two upstanding bars (e.g., FIG. 6A). The product basket may comprise a plurality of baskets configured to mount to the plurality of rungs to position the plurality of baskets vertically about a majority of the bracket. For example, baskets may be positioned vertically to hang or be suspended from all but the very top and bottom of the bracket. In one form, the vertical bracket and plurality of baskets mounted thereto comprise a bracket and basket set. Further, the display may comprise a plurality of bracket and basket sets positioned side-by-side in the display with the plurality of bracket and basket sets having a first bracket and basket set configured for use with a first product and a second bracket and basket set configured for use with a second product, different than the first product (e.g., FIG. 1A).

Thus, with this configuration, multiple different products may be displayed side-by-side one another and stacked or stored in the display in a way that is best suited for that particular product. For example, some yogurts come in a smaller package (e.g., smaller in height, width, etc.), while others come in a larger package (e.g., larger in height, width, etc.). By using a bracket and basket set that is specific to the product being displayed, the display can be customized for the products which in turn yields a more densely packed display (e.g., improved horizontal and/or vertical pack out). By allowing a retail owner to more densely pack a display, the retail owner is effectively gaining real estate in his or her store to do with as he or she so chooses (e.g., utilizing the extra space to add more products or SKUs, utilizing the extra space to add marketing or promotional items to make the display more attractive, utilizing the extra space for advertising which the owner my sell or lease to suppliers or manufacturers looking to promote a product, brand or the manufacturer itself).

In one form, the rungs of the vertical bracket are spaced at predetermined intervals. Each basket of the plurality of baskets in each bracket and basket set have dimensions of length, width and height. The first bracket and basket set is configured for use with the first product by selecting at least one of the rung interval spacing and the basket dimensions based on particulars of the first product and the second bracket and basket set is configured for use with the second product by selecting at least one of the rung interval spacing and the basket dimensions based on particulars of the second product. Thus, although movement of the baskets is limited to predetermined intervals along the vertical support, in a preferred form these intervals are designed for a specific brand and thus still allow the retail owner to customize the display for a particular product (e.g., a particular type of product, a particular brand of product, a particular manufacture of products, etc.).

In the form illustrated, the basket may be formed from a plurality of U-shaped supports interconnected to one another via at least one lower channel member located at the bottom of the U-shaped support and first and second side members located on opposite sides of the U-shaped support (e.g., FIG. 7) to form a generally U-shaped channel defining a lower surface and a first and second side surface. The forward most U-shaped support defines at least a portion of the open front of the basket through which displayed product is moved, and the lower channel member defines the bottom surface of the basket. The first and second side members define the opposing side surfaces of the basket which may limit lateral movement of the product. In addition, the basket may be suspended from the at least one post at a downward angle to bias product stored in the display toward the open front (e.g., to automatically move the product from the rear of the basket toward the front of the basket so that is self-facing). The basket may further comprise projections extending inward toward a center of the open front of the basket to hinder inadvertent removal of product from the product display (e.g., FIG. 7). For example, the forward most U-shaped support may be configured with a protrusion or detent for preventing the product stored in the display from inadvertent removal from the display, such as from simply falling out of the display.

In one form, the basket further includes an insert disposed in the internal channel of the basket (e.g., FIGS. 14A-B, 15-16B and 28A-29D). The insert may comprise at least one of an airflow directing member for guiding chilled air across product stored in the basket and a friction reducing member for assisting with movement of product through the basket. In the form illustrated in FIGS. 14A-B, an airflow directing insert is illustrated. While this insert directs chilled air across the products contained in the basket, the product do not rest on the insert or come into contact with same and, thus, the insert does not serve a friction reducing role. Conversely, the inserts of FIGS. 15-16B and 28A-29D serve a dual role as both an airflow directing insert and a friction reducing insert because at least some of the displayed product comes into contact with the insert and the insert helps reduce the friction between the product and the basket so that the product moves through the display more easily.

In some forms, the insert of the product display may be a reversible insert like that illustrated in FIGS. 28A-29D. For example, the insert may have first and second ends disposed in the internal channel of the basket and moveable between a first position wherein the first end of the insert is positioned proximate the open front of the basket having a structure for displaying product information relating to product displayed in the basket and a second position wherein the second end of the insert is positioned proximate the open front of the basket. Instead of having a product information structure, the insert could be configured with other items that are useful to have in some displays, but that may not always be desired. For example, in alternate forms, the insert may be reversible and have one orientation where a protrusion or detent is present to further assist in hindering inadvertent removal of product from the display and another orientation without such a protrusion or detent. In another form, the insert may be configured with a landing or receptacle on one end for receiving the forward most product to face the product in a desired manner and be placed in another orientation where the landing is not utilized.

It should also be understood that while the inserts depicted are reversible by rotating the insert about a vertical axis so that the same surface of the insert is always positioned upward toward the displayed product, in alternate forms, the insert may be reversible by being rotated about a horizontal axis (or longitudinal axis) of the insert so that in one orientation one side of the insert is facing up and in another orientation the opposite side of the insert is facing up (or the original side is facing down). For example, in one form the insert may have a first or ribbed side for the displayed product to travel along and an opposite second or smooth surfaced side that the insert may be rotated to if such a surface is preferred for a particular application over the ribbed surface.

The display may also include a structure (e.g., a price channel or display) for displaying product information relating to product displayed in the basket (e.g., FIGS. 12A-B). In a preferred form, the structure is moveable (e.g., rotatable, pivotal, etc.) between a first position wherein a first form of information is provided (e.g., price, current sale/deal/special information, SKU number, bar code, product type, brand information, manufacturer information, nutritional information, health characteristic of the food, e.g., lean beef, gluten-free, food grade such as Prime, etc.) and a second position wherein a second form of information different from the first form of information (e.g., rotatable, pivotal, etc.) between a first position wherein a first form of information is provided (e.g., price, current sale/deal/special information, SKU number, bar code, product type, brand information, manufacturer information, nutritional information, health characteristic of the food, e.g., lean beef, gluten-free, food grade such as Prime, etc.) is provided. In the form illustrated, the price channel comprises a rotatable and transparent sleeve that an insert may be disposed in to display product information. The sleeve also protects the insert from smudging or marring that might otherwise occur with daily wear and tear and allows the surface of the sleeve to be cleaned easily without harming the insert or requiring additional care to be taken in order to prevent the insert from being damaged (e.g., ripped, wet, etc.).

Any of the display embodiments discussed herein may be installed in a retail establishment. At least a portion of the display is colored to match a trade dress of at least one of the retail establishment, a type of product being displayed in the display, a manufacturer of product being displayed in the display or a brand of product being displayed in the display. For example, if a particular grocery chain has a recognized two-color trade dress, the display could be designed to match this trade dress (e.g., the brackets could be made in one color and baskets in another, the bracket and basket sets could alternate in color to match the trade dress, the insert and baskets could be provided in different color to match the trade dress). In another example, the display may be color coded to match the trade dress of the particular products being displayed to make it easier for a consumer to locate her or his preferred brand. For example, one or more bracket and basket sets may be colored in brand A's colors or trade dress to signify they contain that brand of product while one or more additional bracket and basket sets are colored in brand B's colors or trade dress to signify they contain brand B product. It should also be understood that one or more of the bracket and basket set components (e.g., basket, insert, bracket, etc.) may be provided in such colors to match a desired trade dress and that, in alternate forms, portions of any component of the bracket and basket could also be provided in such colors to match a desired trade dress (e.g., individual wires of the basket may alternate in color to match trade dress, inserts may be provided in multi-tone color to match a desired trade dress or so on for the other components.

In accordance with aspects of the invention, the basket used with the display may comprise a multi-basket unit that is mounted to the vertical support member using a common mounting member. For example, as mentioned above, the vertical support may include at least one post that the multi-basket unit is mounted to via a common mounting member such as a hook or hanger. The multi-basket unit may further comprise at least one of a multi-row basket unit, a multi-column basket unit or a multi-row and column basket unit (e.g., FIGS. 21A-23B). Thus, such units provide an array of baskets or matrix of baskets that can be suspended from a common mounting member or hanger. This may be particularly helpful when setting-up the display and/or when restocking the display if baskets are to be removed for such purposes due to the time savings such a multi-basket unit would provide in these situations.

In any of the display embodiments discussed above, the product display may include upper and lower mounting channels for supporting distal ends of the at least one post or vertical support (e.g., FIGS. 4 & 5B). The mounting channels have mounting brackets for securing the mounting channels to the display, with at least one of the upper and lower mounting channels being moveable with respect to the mounting brackets to allow for the mounting channels to be repositioned with respect to the mounting brackets. This allows the display to be further customized by the user and allows for the mounting channels to be aligned more easily with one another and/or moved to eliminate unwanted gaps or the like so that the display can maximize horizontal pack out within the display itself.

As illustrated best in FIG. 4, the mounting brackets 136 and channel members 132 are designed so that either the channels 132 can be moved to eliminate the illustrated gap or the bracket itself could be positioned to traverse the gap. Although the gap illustrated is located in the center of a conventional open air commercial refrigeration unit having two lower channels and two upper channels, this illustration also makes clear how the channel and mounting bracket configuration of FIG. 4 (as compared to the channel and bracket configuration of FIGS. 2A-3B) would allow more of the channel to be used to mount vertical supports and, thus, how the display allows for greater horizontal pack out in conventional refrigeration units. For example, with the channel and bracket configuration of FIGS. 2A-3B, the refrigeration unit can only hold the number of vertical supports that fit within the channel between the mounting brackets. Thus, this limits the horizontal width of the display that can be used and, in cases where two separate side-by-side channel members are used in both the top and bottom of the refrigerator, guarantees that a gap will exist in the middle of the refrigeration unit between the two side-by-side channel members because a vertical support cannot traverse the gap from one channel member to the other as there are two mounting brackets in the way. Whereas, with the channel members and brackets of FIG. 4, vertical supports can extend out over the end of each channel member and/or can traverse the gap that exists between the two side-by-side channel members thereby allowing the user to maximize the amount of space used by the display and the horizontal pack out of the display (meaning increased retail space or real estate for the user of the display).

In addition to the above, some forms of the display may further include an alignment or guide structure or upper runner (e.g., FIG. 25A) for guiding product displayed in the display baskets. In a preferred form, the alignment structure guides product moving through the basket over at least a portion of travel through the basket to hinder misalignment of the product or interference with the operation of the display. In other words, the alignment structure stabilizes the product from tipping over from its resting surface. In the form illustrated, the alignment structure only engages a portion of the product displayed in the display should some of the product start to get misaligned (e.g., topple or tip). In the form illustrated in FIG. 25A the alignment structure or guide extends from a side of the basket and over the product. In the form illustrated in FIG. 26, an alternate alignment mechanism or guide is depicted that is positioned on the bottom of the basket to help guide or align product in the basket below.

An alternate embodiment of a basket product display has been illustrated in FIGS. 17A-D. In this form, the display includes a plurality of product baskets that are configured to mount to vertical supports (e.g., at least one post) in a way that allows the baskets to be continuously adjusted in the vertical direction rather than being limited to predetermined incremental adjustments. In the form illustrated, the vertical supports comprise a plurality of posts and the mounting members of each basket are formed form a plurality of arms with each arm engaging a first set of posts from the plurality of posts to suspend the basket from the plurality of posts and form a column of baskets positioned vertically on the display. The display further includes a second column of baskets positioned vertically on the display side-by-side with the first column of baskets, with each basket of the second column of baskets having a plurality of arms engaging a second set of posts from the plurality of posts.

As is best illustrated in FIGS. 17D and 18B, in a preferred form, at least some of the plurality of arms of the first and second column of baskets are arranged to overlap with one another so that the first and second column of baskets may share a common post from the plurality of posts while allowing baskets in the first and second column of baskets to be positioned side-by-side one another at similar heights along the plurality of posts (e.g., FIG. 17D). More particularly, in the form illustrated, each basket has first and second arms extending therefrom which form the mounting members by which the basket suspends from the vertical supports. In a preferred form, the first arm will extend to a first height and the second arm will extend to a second height, different than the first. Thus, when two baskets are positioned adjacent one another, the first arm of one of the baskets will overlap with the second arm of the other basket so that the baskets may be positioned at a uniform height on the vertical support. As mentioned above, the side walls of the baskets are preferably designed to prevent the product of one basket from interfering with the product of another basket positioned adjacent or along the side of the first basket. However, this does not mean that portions of the product cannot overlap with a vertical plane containing an outer edge of the product disposed within the basket. In some instances such an overlap may be desired so that the product displayed within the basket can utilize the basket or basket sidewalls to align or guide the product as it moves through the basket (e.g., as it moves from the rear of the basket toward the front of the basket). For example, yogurt may be stored in the basket and the baskets may be designed so that the lip or outer edge of the yogurt container rests on an upper surface (or surfaces) of the side wall (or side walls) of the basket to help align or guide the yogurt container as it moves through the basket. In a specific form, the basket may be designed so that the length of the basket is approximately five times greater than the width of the basket and the upper surface of the length of the basket is used as such a guide for the product stored in the basket.

In other examples, a basket product display is provided comprising a plurality of individual vertical supports and a plurality of baskets comprising a mounting portion configured to mount to each vertical support to form a vertical support and basket set and a display portion having a plurality of side structures and a product support structure. The plurality of side structures and the product support structure are configured to at least partially enclose and limit movement of a product displayed therein. The plurality of baskets are further configured to display product in a front-facing manner in which product from a rear of the product basket is automatically biased toward a front of the product basket. In one form, the baskets are constructed of wires. The product baskets are configured to maximize pack out in the vertical direction within the product display by spacing the baskets vertically on the vertical supports to provide adequate clearance for the particular product displayed in each basket and minimizing gaps that occur between the plurality of baskets mounted to the vertical support, wherein the plurality of vertical supports and the plurality of baskets are configured to maximize pack out in the horizontal direction within the product display by having each vertical support and basket set configured to display a particular product to provide adequate clearance horizontally between each vertical support and minimize gaps between each vertical support and basket set and each basket mounted to each vertical support. In other words, the baskets may be spaced to ensure movement of the product from a rear end of the basket to a front end of the basket is not interfered with by adjacent baskets or products disposed therein.

In one form of the invention, at least one basket extends from at least one vertical support at a downward angle to allow gravity to assist in moving the product towards a front portion of the basket. Further the plurality of side structures located on the baskets to prevent inadvertent removal of product from the display include at least one protrusion extending inwardly into the product display area to impede removal of the product from the basket. In a preferred form, the protrusion will be rounded or bell-mouthed to make stocking of product or merchandise in the display and re-merchandising of product temporarily removed from the display easier.

In another form of the invention, the display comprises a basket product display having a plurality of individual vertical supports; and a plurality of baskets comprising a mounting portion configured to mount to each vertical support to form a vertical support and basket set and a display portion having a plurality of side structures and a product support structure, the plurality of side structures and the product support structure configured to at least partially enclose and limit movement of a product displayed therein, the plurality of baskets further configured to display product in a front-facing manner in which product from a rear of the product basket is automatically biased toward a front of the product basket. Wherein the product baskets are configured to maximize pack out in the vertical direction within the product display by spacing the baskets vertically on the vertical supports to provide adequate clearance for the particular product displayed in each basket and minimizing gaps that occur between the plurality of baskets mounted to the vertical support, wherein the plurality of vertical supports and the plurality of baskets are configured to maximize pack out in the horizontal direction within the product display by having each vertical support and basket set configured to display a particular product to provide adequate clearance horizontally between each vertical support and minimize gaps between each vertical support and basket set and each basket mounted to each vertical support.

The basket product display may include at least one basket extending from at least one vertical support at a downward angle to allow gravity to assist in moving the product towards a front portion of the basket, wherein the plurality of side structures include at least one protrusion extending inwardly into the product display area to impede removal of the product from the basket. The basket product display may also include a member inserted into the basket that is at least one of an airflow directing member and a friction-reducing member, wherein the member comprises a reversible member comprising a top surface, bottom surface, first end, second end, and a mating structure located along the bottom surface, wherein the mating surface is configured to mate the reversible member to the basket in a first configuration such that the first end of the reversible member extends distally from the vertical support and mate the reversible member to the basket in a second configuration such that the second end of the reversible member extends distally from the vertical support. At least one of the first end or the second end of the reversible member may include an information display structure configured to contain product information.

The basket product display (or any of the components thereof) may be colored to match a color scheme of at least one of a particular product, product type, or retail location. In some forms, at least some of the plurality of baskets form an integral multi-basket display configured to arrange the product in at least one of rows or columns and suspend the at least some of the plurality of baskets from a common mounting portion. In some forms, the basket product display may also include an alignment structure coupled to the basket, the alignment structure being configured to stabilize a product displayed in the basket when the product moves toward a front portion of the basket.

In other examples, a method for displaying a product is described. The method includes mounting a plurality of vertical brackets to a product display cooler, mounting a plurality of product display baskets to the plurality of vertical brackets, the plurality of product display baskets having side walls configured to display a particular type of product such that movement of a product from a rear end of the product display basket to a front end of the product display basket is not interfered with by adjacent product display baskets or products disposed in the adjacent product display baskets, and placing a plurality of products in the plurality of product display baskets. The plurality of product display baskets are mounted to the plurality of vertical brackets at a downward angle. The method may further include inserting a friction reducing component into one or more of the baskets of the display that is configured to reduce friction between the displayed product and the product display basket.

Methods of displaying product are also disclosed herein. In one exemplary method a method of displaying product comprises providing a plurality of individual vertical supports and a plurality of baskets mounted to each vertical support to form a plurality of vertical support and basket sets, and configuring one or more of the vertical support and basket sets to maximize pack out in either or both the vertical and horizontal directions within the product display by having the one or more of the vertical support and basket sets configured to display a particular product, provide adequate clearance horizontally between each vertical support and basket set and vertically between each basket mounted to each individual vertical support and minimize gaps between each vertical support and basket set and each basket mounted to each individual vertical support. Thus, in some forms the method comprises displaying product using a plurality of vertical support and basket sets wherein one or more of the sets is designed specifically to display a first product and one or more of the sets is designed specifically to display a second product different from the first.

Other methods include methods of manufacturing or assembling any of the embodiments or features discussed above or displaying with any of the embodiments or features discussed above. For example, in another method according to the invention, a method of manufacturing and/or assembling a display comprises providing a plurality of U-shaped supports, interconnecting one or more of the U-shaped supports to one another with at least one lower channel member located at the bottom of the U-shaped support and first and second side members located on opposite sides of the U-shaped support, with the forward most U-shaped support defining at least a portion of the open front of the basket, the lower channel member defining the bottom surface of the basket and the first and second side members defining the opposing side surfaces of the basket. The method may further include inserting an insert into the basket defined by the U-shaped supports and/or securing the insert to the basket. In other forms the method further comprises providing a structure (e.g., a protrusion or detent) to prevent inadvertent removal of product from the display and, in a specific form, bending a portion of the basket to form such a structure. Another method includes assembling multi-basket units and connecting such units to vertical supports using a common mounting member (e.g., a hanger or hangers, etc.).

In other aspects of the invention, methods of manufacturing basket type product displays are provided. For example, in one form a method is provided that includes the steps of fabricating a vertical bracket having at least one mounting arm coupled thereto, and fabricating a product display basket having at least one mounting region configured to mate the product display basket to the vertical bracket. The product display basket is fabricated to contain a particular type of product to ensure movement of the product from a rear end of the product display basket to a front end of the product display basket is not interfered with by items contained outside of the product display basket. In one form, the method further comprises fabricating additional vertical brackets and product display baskets, wherein the vertical brackets are configured to align next to adjacent vertical brackets. The step of fabricating additional product display baskets may comprise fabricating product display baskets configured to be displayed in close proximity to vertically and horizontally adjacent product display baskets.

A method of providing a multi-columned product basket display is also disclosed comprising at least a first and second wire basket unit having a plurality of side walls for limiting lateral movement of a product and a runner for supporting a bottom surface of a product is provided. The method comprises the steps of positioning the first wire basket unit vertically adjacent to the second wire basket, and forming an integral multi-basket display configured to arrange the product in columns. The method may further comprise positioning a third wire basket unit having a plurality of side walls for limiting lateral movement of a product and a runner for supporting a bottom surface of the product vertically adjacent to the first or second wire basket units, and forming an integral multi-basket display configured to arrange a product in columns.

Another embodiment of the invention includes a method comprising positioning additional wire basket units having a plurality of side walls for limiting lateral movement of a product and a runner for supporting a bottom surface of the product adjacent to the first and second wire baskets, and forming an integral multi-basket display configured to arrange a product in a matrix. Further still, the method may comprise suspending the first and second wire basket units from a vertical bracket at a downward angle and coupling a friction-reducing component to at least one of the first and second wire basket units to reduce friction between the product and the wire basket units.

Those skilled in the art will recognize that a wide variety of modifications, alterations, and combinations can be made with respect to the above described embodiments without departing from the scope of the invention, and that such modifications, alterations, and combinations are to be viewed as being within the ambit of the inventive concept.

What is claimed is:

1. A product display capable of being configured to improve product pack out in a display comprising:

an upper mounting channel and a lower mounting channel;

a plurality of individual vertical supports, wherein at least some of the plurality of individual vertical supports are movable within the upper and lower mounting channels with respect to others of the plurality of individual vertical supports; and a plurality of product dispensers connected to the plurality of individual vertical supports to form support and dispenser sets, at least a first one of the plurality of individual vertical supports being sized or dimensioned based on a corresponding first product dispenser of the plurality of product dispensers, the first product dispenser being sized or dimensioned based on a first specific product, and not generic to multiple products, to be displayed in the first product dispenser to improve product pack out in the display; and at least a second of the plurality of individual vertical supports being sized or dimensioned based on a corresponding second product dispenser of the plurality of product dispensers the second product dispenser having different dimensions than the first product dispenser.

2. The product display of claim 1, wherein the plurality of individual vertical supports have first mating structures and the plurality of product dispensers have second mating structures that mate with the first mating structures to suspend the product dispensers from the plurality of individual vertical supports, at least one of the first and second mating structures being positioned to reduce spatial gaping between the product dispensers of one of the support and dispenser sets to improve vertical product pack out with respect to the support and dispenser set.

3. The product display of claim 2, wherein at least one of the first mating structures and the second mating structures is configured to suspend the product dispensers in the support and dispenser set at a predetermined angle that biases specific product to be displayed in the product dispensers toward a front of each of the product dispensers to automatically front face the specific product to be displayed in the product dispensers, the predetermined angle based on the specific product to be displayed in the product dispensers so that the predetermined angle is sufficient for purposes of front facing the specific product to be displayed in the product dispensers but small enough of an angle to improve the number of product dispensers that can be connected to the vertical support of the support and dispenser set to improve vertical product pack out with respect to the support and dispenser set and the display.

4. The product display of claim 3, wherein each support and dispenser set is of a size or dimension for the specific product to be displayed in the product dispensers so that each support and dispenser set provides sufficient room for the front facing of the specific product to be displayed in the dispensers of each support and dispenser set but narrow enough to improve the number of support and dispenser sets that can fit within the display to improve horizontal product pack out with respect to the display.

5. The product display of claim 4, wherein the upper and lower mounting channels include unobstructed passages within which the plurality of individual vertical supports of the support and dispenser sets may be disposed, the upper and lower mounting channels being open ended to allow at least one vertical support of the plurality of individual vertical supports to extend laterally beyond an end of the upper and lower mounting channels to improve horizontal product pack out of the display.

6. The product display of claim 5, wherein the upper and lower mounting channels are positioned proximate one another, the upper and lower mounting channels allow at least one vertical support of the plurality of individual vertical supports to be disposed in a passageway defined by the upper and lower mounting channels positioned proximate to one another traversing any gap that can exist therebetween.

7. A basket product display comprising:

a first set of vertical supports, wherein each vertical support of the first set of vertical supports includes rungs spaced at a first distance;

a second set of vertical supports, wherein each vertical support of the second set of vertical supports includes rungs spaced at a second distance, the second distance being different from the first distance;

a first set of product baskets including mounting members for engaging one or more of the rungs at the first distance and configured to display a first product;

a second set of product baskets including mounting members for engaging one or more of the rungs at the second distance and configured to display a second product, wherein, the second product is different than the first product; and wherein the first distance is based on dimensions of the first product and the second distance is based on dimension of the second product.

8. The product basket display of claim 7, further comprising: at least one mounting channel, wherein the first set of vertical supports and the second set of vertical supports are moveable about the at least one mounting channel.

* * * * *